US008142311B2

(12) United States Patent
Krysiak

(10) Patent No.: US 8,142,311 B2
(45) Date of Patent: Mar. 27, 2012

(54) GAME BALL HAVING OPTIMALLY POSITIONED GROOVES AND/OR RIDGES

(75) Inventor: Kevin L. Krysiak, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 286 days.

(21) Appl. No.: 12/005,014

(22) Filed: Dec. 21, 2007

(65) Prior Publication Data

US 2008/0108462 A1 May 8, 2008

Related U.S. Application Data

(63) Continuation-in-part of application No. 11/497,993, filed on Aug. 2, 2006, now Pat. No. 7,585,236.

(51) Int. Cl.
*A63B 41/08* (2006.01)

(52) U.S. Cl. ..... 473/603; 473/597

(58) Field of Classification Search ..... 473/596, 473/597, 599, 603–605, 696, 609, 600–602; D21/713

See application file for complete search history.

(56) References Cited

U.S. PATENT DOCUMENTS

| | | | | | |
|---|---|---|---|---|---|
| 1,171,238 | A | * | 2/1916 | Pierce | 473/599 |
| 1,931,429 | A | * | 10/1933 | Buckner et al. | 473/596 |
| 2,091,455 | A | | 8/1937 | Riddell | |
| 2,129,238 | A | * | 9/1938 | Riddell | 473/604 |
| 2,143,409 | A | | 1/1939 | Denkert | 473/597 |
| 2,194,674 | A | * | 3/1940 | Riddell | 473/597 |
| 2,219,078 | A | | 10/1940 | Reach | 473/607 |
| 2,244,503 | A | * | 6/1941 | Riddell | 473/597 |
| 2,525,261 | A | | 10/1950 | Henderson | 221/150 |
| 2,975,823 | A | | 3/1961 | Ponnock | 156/245 |
| 3,256,019 | A | | 6/1966 | Barton | 273/65 |
| 3,315,640 | A | | 4/1967 | Gamble | 119/707 |
| 3,863,923 | A | | 2/1975 | Anderson | 273/58 BA |
| 3,884,466 | A | | 5/1975 | MacDonald et al. | 473/613 |
| 4,736,948 | A | | 4/1988 | Thomas | 473/613 |
| 4,772,020 | A | | 9/1988 | Martin | 273/65 EE |
| RE33,449 | E | * | 11/1990 | Martin | 473/613 |
| 5,165,685 | A | | 11/1992 | Hynes | 273/65 EG |
| D335,906 | S | * | 5/1993 | Hellerman | D21/712 |
| D340,489 | S | | 10/1993 | Evangelista | D21/713 |
| 5,269,526 | A | | 12/1993 | Wollstein | 473/159 |
| 5,310,178 | A | | 5/1994 | Walker et al. | 273/65 B |
| 5,451,046 | A | | 9/1995 | Batton | 273/55 C |
| 5,833,897 | A | | 11/1998 | Grimm | 264/46.5 |
| 5,865,697 | A | | 2/1999 | Molitor et al. | 476/605 |
| 5,881,885 | A | | 3/1999 | Grimm | 206/779 |
| 5,888,157 | A | | 3/1999 | Guenther et al. | 473/604 |
| D409,904 | S | | 5/1999 | Clements et al. | D9/668 |
| 6,099,423 | A | | 8/2000 | Ou | 473/604 |
| 6,123,633 | A | | 9/2000 | Guenther et al. | 473/604 |
| 6,168,539 | B1 | | 1/2001 | Maina | 473/424 |

(Continued)

*Primary Examiner* — Steven Wong
(74) *Attorney, Agent, or Firm* — Terence P. O'Brien

(57) ABSTRACT

A football having a generally prolate spheroidal shape and opposing first and second ends. The football includes a bladder, a cover and a lacing coupled to the cover. The cover is disposed over the bladder and defines, at least in part, a first set of channels extending generally longitudinally from at or near the first end of the football to at or near the second end of the football. The cover is formed of at least one cover panel. The cover has an outer surface and includes a plurality of outwardly projecting ridges configured to facilitate grasping and throwing of the football. The height of the ridge is greater than or equal to 0.7 mm and less than or equal to 10 mm.

24 Claims, 21 Drawing Sheets

U.S. PATENT DOCUMENTS

| | | | | |
|---|---|---|---|---|
| RE37,468 | E | 12/2001 | Kennedy et al. | 473/599 |
| 6,398,894 | B1 | 6/2002 | Lee | 156/147 |
| 6,422,961 | B1 | 7/2002 | Feeney | 473/604 |
| 6,578,527 | B1 | 6/2003 | Mathers | 119/707 |
| D478,641 | S | 8/2003 | Kuehne | D21/713 |
| 6,634,970 | B2 | 10/2003 | Jiminez | 473/597 |
| D483,424 | S * | 12/2003 | Lowinger | D21/713 |
| 6,752,732 | B2 | 6/2004 | Morrison et al. | 473/604 |
| 6,863,588 | B1 | 3/2005 | Chu | 446/487 |
| D505,462 | S | 5/2005 | Horkan et al. | D21/712 |
| 6,908,662 | B2 * | 6/2005 | Pearce | 428/188 |
| D518,536 | S | 4/2006 | Chang | D21/712 |
| 7,037,224 | B1 | 5/2006 | Page et al. | 473/596 |
| D524,878 | S | 7/2006 | Kort et al. | D21/464 |
| D537,483 | S | 2/2007 | Kort et al. | D21/466 |
| D544,052 | S * | 6/2007 | Krysiak | D21/713 |
| D544,053 | S * | 6/2007 | Krysiak | D21/713 |
| D562,419 | S | 2/2008 | Crane et al. | D21/712 |
| D570,431 | S * | 6/2008 | Krysiak | D21/712 |
| D570,432 | S * | 6/2008 | Krysiak | D21/712 |
| D570,931 | S * | 6/2008 | Krysiak | D21/712 |
| D571,874 | S * | 6/2008 | Krysiak | D21/712 |
| 7,585,236 | B2 * | 9/2009 | Krysiak | 473/604 |
| 2003/0073526 | A1 | 4/2003 | Morrison et al. | 473/604 |
| 2004/0224805 | A1 | 11/2004 | Morrison et al. | 473/604 |
| 2007/0178997 | A1 * | 8/2007 | Chang | 473/603 |

* cited by examiner

FIG. 3
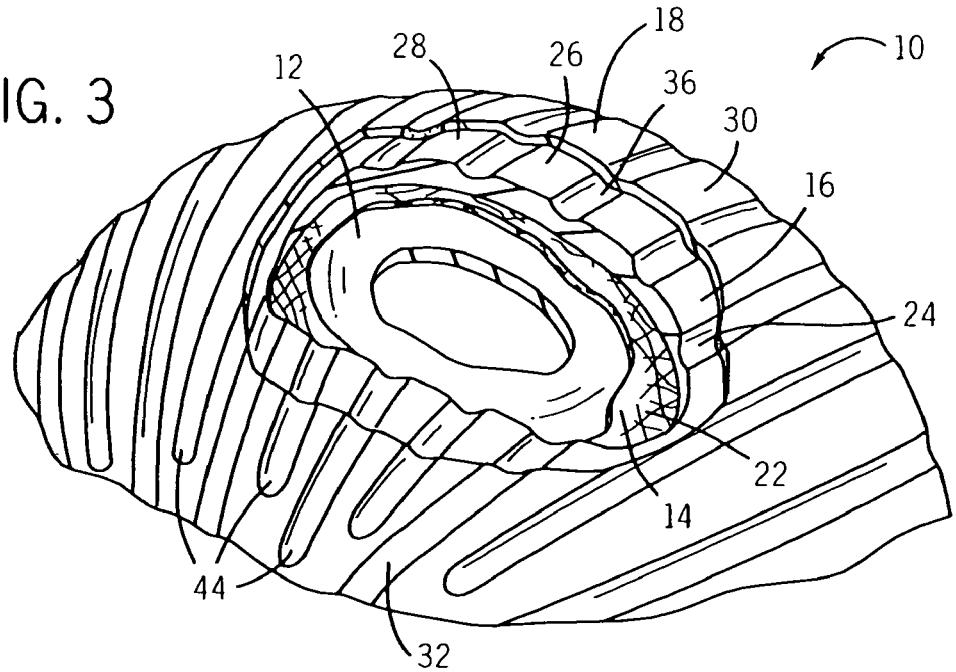
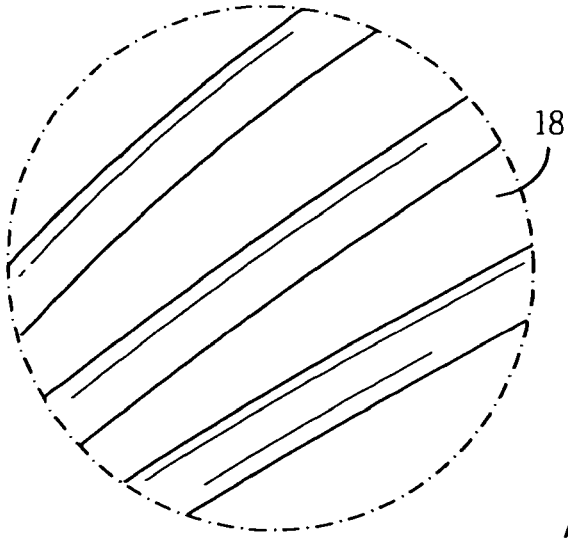
FIG. 4
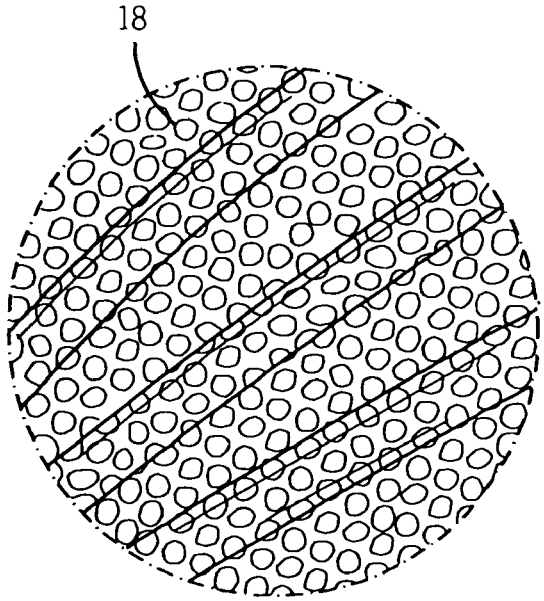
FIG. 5

FIG. 35
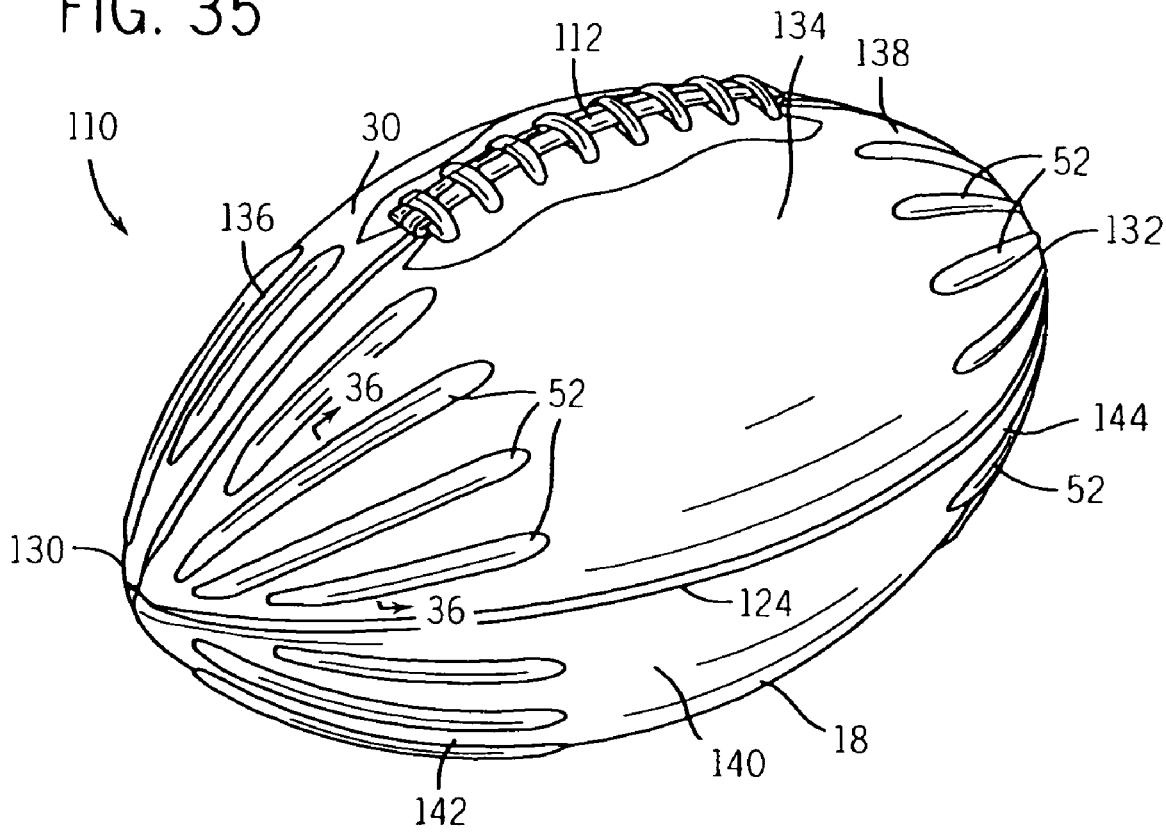
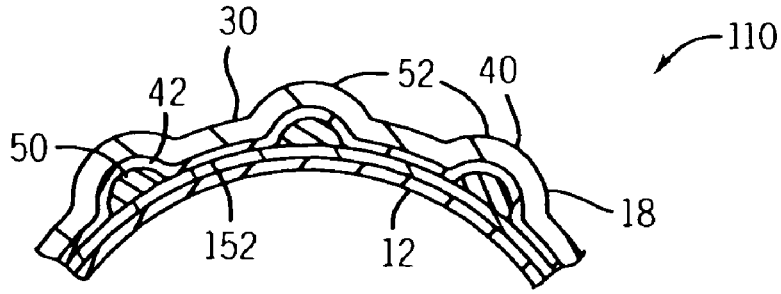
FIG. 36

GAME BALL HAVING OPTIMALLY POSITIONED GROOVES AND/OR RIDGES

RELATED U.S. APPLICATION DATA

The present invention is a continuation-in-part of U.S. patent application Ser. No. 11/497,993, entitled "Game Ball Having Optimally Positioned Grooves and/or Ridges," filed on Aug. 2, 2006 now U.S. Pat. No. 7,585,236 by Kevin L. Krysiak. The present application is also related to co-pending U.S. patent application Ser. No. 12/004,761 filed on the same day herewith by Kevin L. Krysiak and entitled "Game Ball Having Optimally Positioned Grooves and/or Ridges," the full disclosure of which is hereby incorporated by reference.

FIELD OF THE INVENTION

The present invention relates generally to sport game balls. In particular, the present invention relates to a game ball having an improved construction that provides additional channels and/or ridges to improve the performance of the ball.

BACKGROUND OF THE INVENTION

Game balls for sports such as basketballs, footballs, soccer balls, volleyballs, rugby balls, baseballs and softballs are well known. Many game balls, such as basketballs or American-style footballs, typically include an inflatable bladder covered with a layer of windings and encased in a layer of elastomeric material, referred to as the carcass of the ball. One or more additional layers of material, such as a cover or padding may be placed over portions, or all, of the outer surface of the carcass to form the basketball. Covers of game balls are commonly formed of rubber, leather, synthetic leather or a polymeric material. In some football constructions, the bladder is covered with one or more cover panels that are stitched together. A durable backing layer, or a separate lining can be used in place of the layer of windings and the elastomeric material encasing the windings.

Basketballs typically include an arrangement of interconnected channels formed into the outer surface of the basketball. The channels typically are arranged to define eight to twelve cover regions in the outer surface of the basketball. The channels are typically recessed into the outer surface of the basketball, and the channels can facilitate a player's ability to grasp, handle, shoot, pass, dribble and otherwise control the ball during play. Many players, if given the time during play, will rotate the ball in their hands prior to shooting so that they can align one or more of their fingertips with one or more of the channels. Such alignment can facilitate the player's ability to shoot the ball and to impart a spin on the ball upon shooting. Other players rely on or utilize the recessed channels of a basketball to facilitate one-handed grasping, or overall control, of the basketball.

Many football constructions include a first layer of channels typically formed by the stitching together and inverting of a casing or cover formed of two or more cover panels, typically four cover panels. In other constructions, the first set of channels or seams can be formed in a manner similar to the first set of channels on a basketball. A typical football will also include a lacing that is typically positioned at or along one of the first set of channels of the football. The first set of channels on a football also can facilitate the player's ability to grasp, handle, throw and otherwise control the ball during play. In many cases, a player, such as a quarterback may rotate the football before throwing it such that at least one of the quarterback's finger tips rest in one of the channels or seams.

However, because the channels or seams of existing conventional basketballs and footballs are widely spaced apart about the outer surface of the balls, often the timing of play does not afford a player sufficient time to rotate and/or look at the basketball or football to properly align the channels with the player's fingertips in order to facilitate shooting or throwing, control or one-hand grasping of the basketball or football. Accordingly, most shots made by basketball players, and passes by football players, are made without having sufficient time to orientate the channels of the basketball or football with the player's fingertips.

Thus, a continuing need exists to shorten the time required by a player to locate and orientate the game ball, such as a basketball or football, with his or her fingertips contacting one or more channels in the outer surface of the game ball. Additionally, there is a continuing need for a game ball, such as a basketball or a football, which can be more readily grasped and manipulated by a player with a single hand or with both hands. What is needed is a game ball, such as a basketball or football, that improves the player's ability to easily grasp, handle, pass, shoot, dribble, retain and/or otherwise control the ball during use without radically departing from the ball's traditional design. There is also an ever present need to improve the feel of a game ball, such as a basketball or football, during play. Further, a continuing need also exists to produce a game ball with an improved aesthetic.

SUMMARY OF THE INVENTION

The present invention provides a game ball, such as a basketball or a football, having an outer surface and including a first set of channels formed into the outer surface of the game ball. The game ball includes a bladder, a carcass and at least one cover panel. The carcass covers the bladder and has an outer surface that defines a second set of channels. The cover panel(s) is positioned over the carcass and over at least one of the channels of the second set of channels. The cover panel(s) generally conforms to the shape of the outer surface of the carcass such that the cover panel defines at least one groove in the outer surface of the game ball corresponding to the channels of the second set of channels.

According to a principal aspect of a preferred form of the invention, a game ball, such as a basketball or a football, includes a first set of channels, a bladder, a carcass covering the bladder, a plurality of elongate strips, and a plurality of cover panels. The carcass includes an outer layer having an outer surface that defines a second set of channels. The outer layer is formed of a first material having a first hardness. The elongate strips are disposed within, and at least partially fill, the second set of channels. The strips are formed of a second material having a second hardness that is different from the first hardness. The cover panels are positioned over the carcass and the elongate strips.

According to another preferred aspect of the invention, a game ball, such as a basketball, has an outer surface and a first set of channels formed into the outer surface of the game ball. The game ball includes a bladder, a carcass covering the bladder, and at least one cover panel that is positioned over the carcass. The cover panel has a first region of generally uniform first thickness and a plurality of second regions having an average second thickness that is different from the first thickness. The difference in thickness between the first and second regions is greater than or equal to 0.7 mm and less than or equal to 10 mm.

According to another preferred aspect of the invention provides a game ball, such as a basketball or a football, having an outer surface and a first set of channels formed into the outer surface of the game ball. The game ball includes a bladder, a carcass covering the bladder, and at least one cover panel. The carcass has an outer surface and includes a plurality of outwardly extending ribs. The cover panel(s) is positioned over the carcass and over at least one of the ribs. The cover panel(s) generally conforms to the shape of the outer surface of the carcass such that the cover panel defines at least one outwardly extending ridge corresponding to the rib(s). Each ridge outwardly extends from the remaining portions of the cover panel to define a ridge height of greater than or equal to 0.7 mm and less than or equal to 10 mm.

According to another preferred aspect of the invention a game ball, such as a basketball or a football, has an outer surface and a first set of channels formed into the outer surface of the game ball. The game ball further includes a bladder, a carcass covering the bladder, at least one intermediate panel, and at least one cover panel. The intermediate panel(s) has an outer surface, and is positioned over the carcass. The cover panel(s) is positioned over the carcass and the intermediate panel(s). The cover panel(s) generally conforms to the shape of the outer surface of the intermediate panel so as to form a ridge or a groove in the outer surface of the basketball.

According to another preferred aspect of the invention a football has a generally prolate spheroidal shape and opposing first and second ends. The football further includes a bladder, a cover and a lacing coupled to the cover. The cover is disposed over the bladder and is formed of at least one cover panel. The cover defines, at least in part, a first set of channels extending generally longitudinally from at or near the first end of the football to at or near the second end of the football. The cover has an outer surface defining a plurality of grooves configured to facilitate grasping and throwing of the football. At least one of the grooves is positioned near the first or second end of the football. The depth of the groove is greater than or equal to 0.3 mm and less than or equal to 10 mm. The width and depth of at least one of the grooves is sufficiently sized to receive a portion of one or more fingertips of a user.

According to another preferred aspect of the invention a football has a generally prolate spheroidal shape and opposing first and second ends. The football further includes a bladder, a cover and a lacing coupled to the cover. The cover is disposed over the bladder and is formed of at least one cover panel. The panel defines, at least in part, a first set of channels extending generally longitudinally from at or near the first end of the football to at or near the second end of the football. The cover has an outer surface and includes a plurality of outwardly projecting ridges configured to facilitate grasping and throwing of the football. The height of the ridge is greater than or equal to 0.3 mm and less than or equal to 10 mm.

This invention will become more fully understood from the following detailed description, taken in conjunction with the accompanying drawings described herein below, and wherein like reference numerals refer to like parts.

BRIEF DESCRIPTION OF THE DRAWINGS

FIG. 3 is a layered cut-away view of a portion of the basketball of FIG. 2.

FIG. 4 is a enlarged view of a portion of the outer surface of the basketball taken about circle 4-4 of FIG. 2.

FIG. 5 is an enlarged view of a portion of the outer surface of the basketball taken about circle 4-4 of FIG. 2 in accordance with an alternative preferred embodiment of the present invention.

FIG. 35 is a top, side perspective view of a football in accordance with another preferred embodiment of the present invention.

FIG. 36 is a cross-sectional view of a portion of the top side of the football taken about line 36-36 of FIG. 35.

DETAILED DESCRIPTION OF THE PREFERRED EMBODIMENTS

Figure 1:
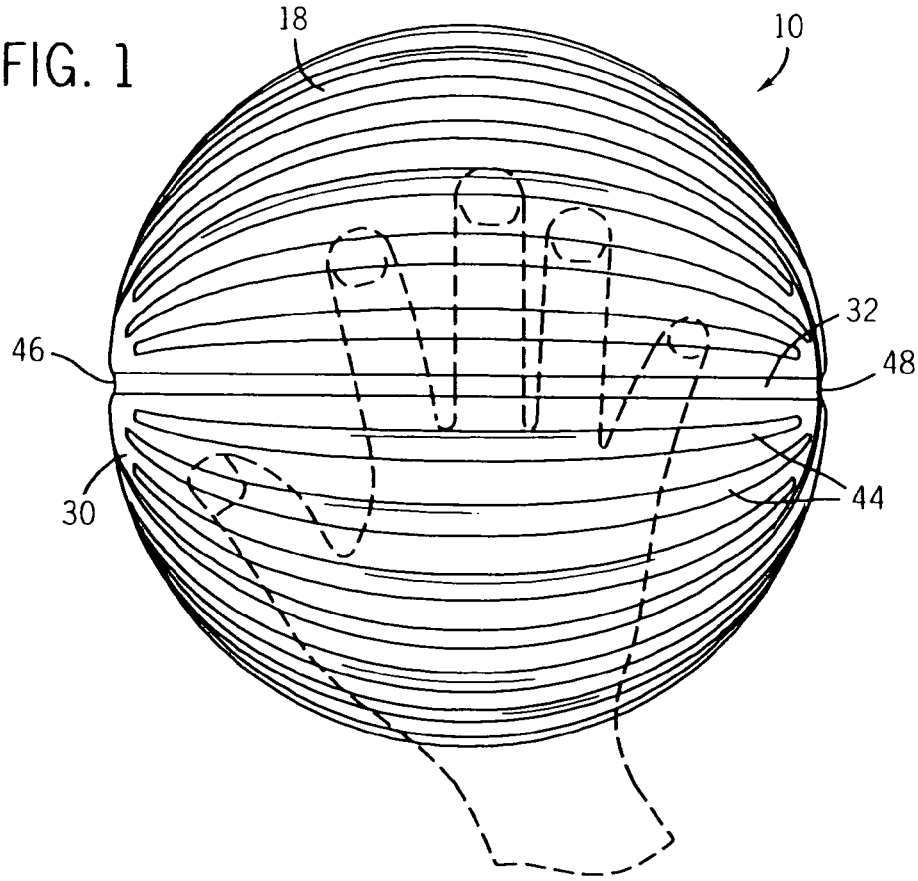
FIG. 1 is a front plan view of a basketball in accordance with a preferred embodiment of the present invention with an outline of a user's hand placed over the basketball.
Figure 2:
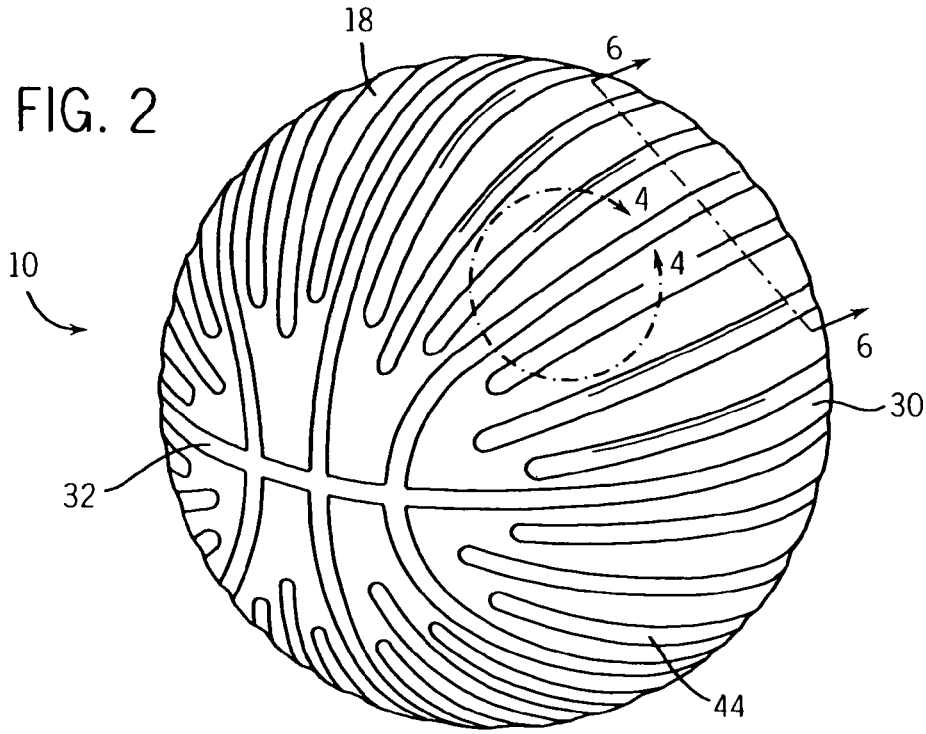
FIG. 2 is a side perspective view of the basketball of FIG. 1.

Referring to FIGS. 1 through 3, a basketball is indicated generally at 10. The basketball 10 is one example of a game ball. The present application is directly applicable to other games balls, including, for example, footballs, rugby balls, soccer balls, and volleyballs.

Figure 18:
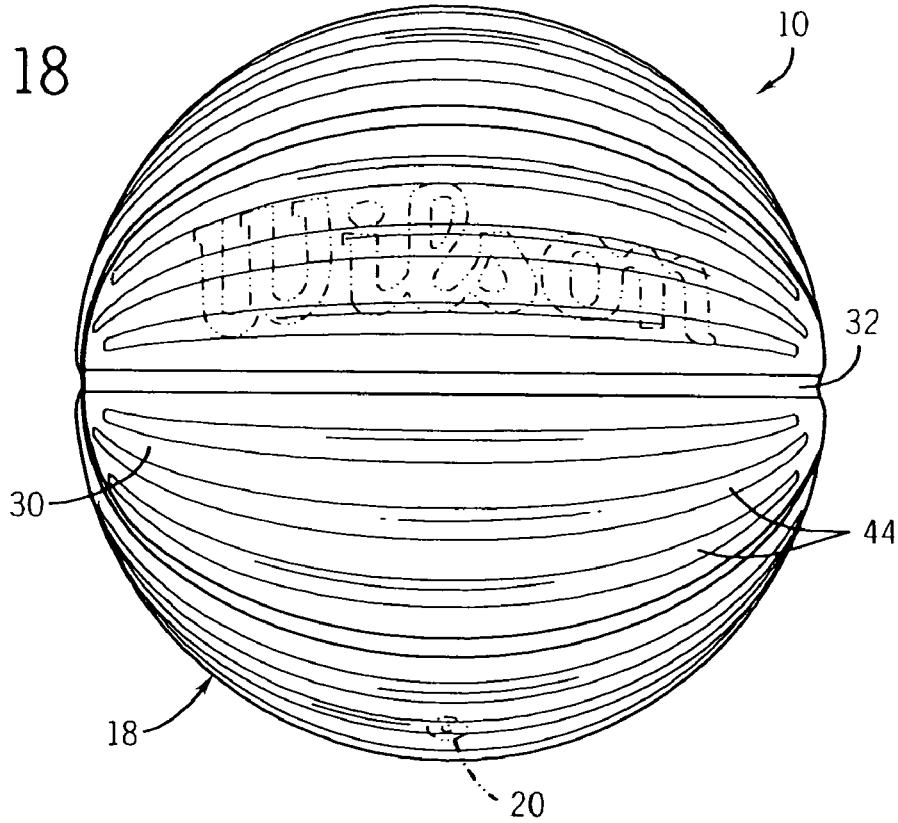
FIG. 18 is a front view of the basketball of FIG. 1 without an outline of a user's hand.
Figure 19:
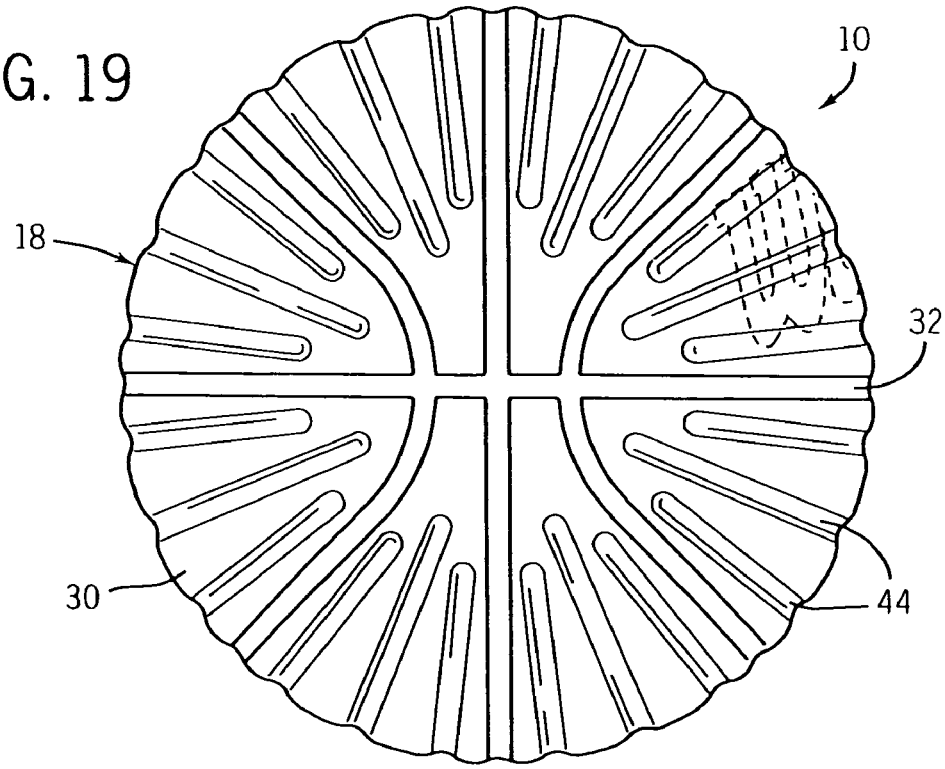
FIG. 19 is a first side view of the basketball of FIG. 1.
Figure 20:
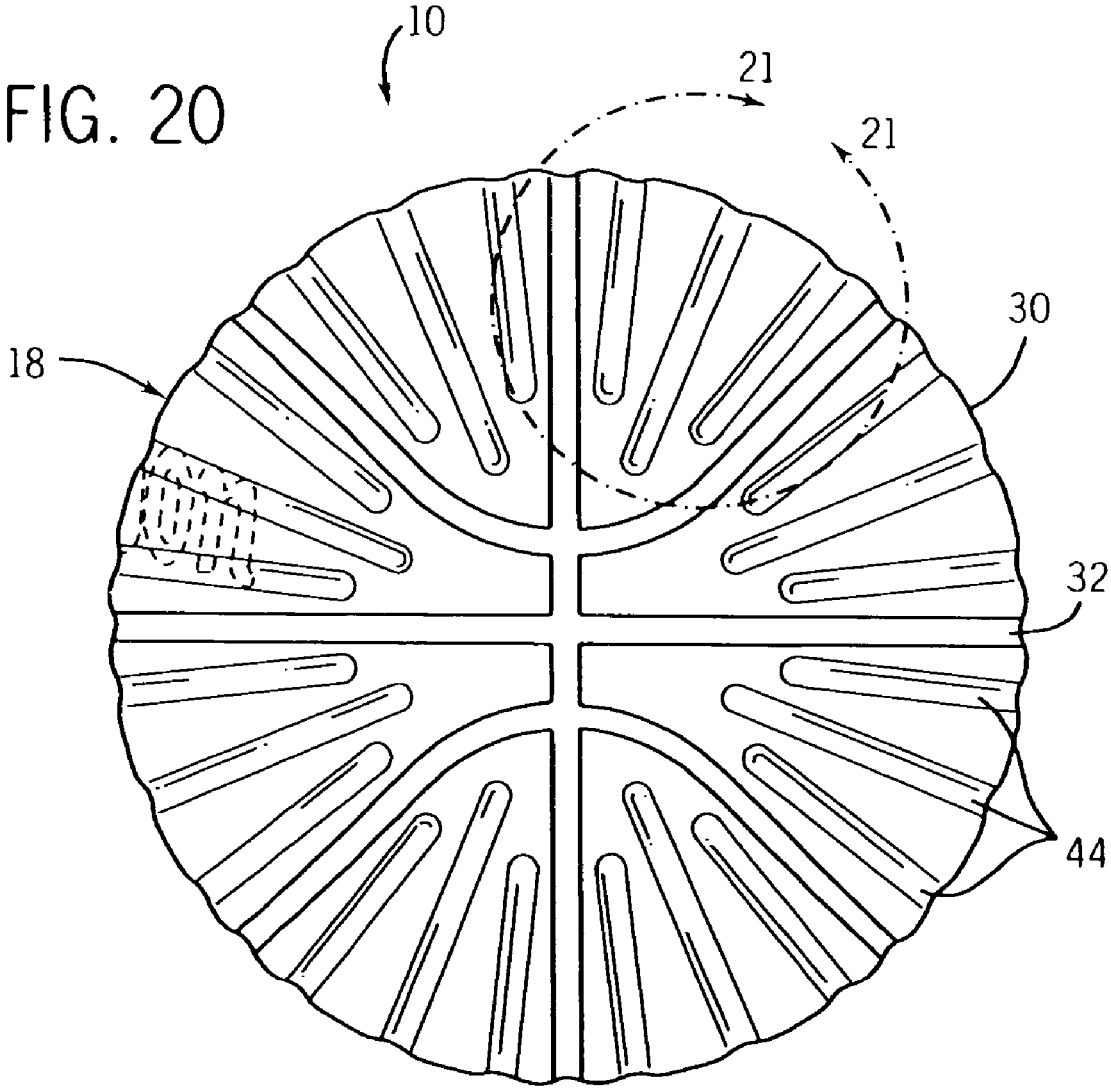
FIG. 20 is a second side view of the basketball of FIG. 1.

The basketball 10 is a spherical inflatable object. Referring to FIG. 3, the basketball 10 preferably includes a bladder 12, a layer of windings 14, a carcass 16 and a cover assembly 18. The bladder 12 is an inflatable air tube preferably having a generally spherical shape. The bladder 12 is disposed within the windings 14, the carcass 16 and the cover assembly 18. In an alternative preferred embodiment, the bladder 12 can be disposed directly within the cover assembly 18. The bladder 12 enables the basketball 10 to retain a predetermined amount of air thereby achieving the desired air pressure within, or firmness to, the basketball 10. The bladder 12 is typically made of latex, butyl rubber or other suitable material. The bladder 12 includes a valve 20 (see FIG. 18) that extends through the windings 14, the carcass 16 and the cover assembly 18 for access by a user.

The layer of windings 14 includes one or more elongate threads 22, which are wound around the bladder 12. The threads 22 form the layer of windings 14 that reinforces the bladder 12 and retains the generally spherical shape of the bladder 12. The threads 22 are formed of a high tensile strength material, preferably nylon. In alternative embodiments, the thread 22 can be a textile, a wire, or other conventional thread material. In a particularly preferred embodiment, the layer of windings 14 is comprised of 2100 meters of 210 denier Nylon thread. In an alternative embodiment, the basketball can be formed without a layer of windings. In another alternative preferred embodiment, the layer of windings can be formed through one or more segments of adhesive tape, or similar material.

The carcass 16 is a generally spherical body disposed over the layer of windings 14. In a preferred embodiment, the carcass 16 is formed by placing a plurality of carcass segments onto an outer surface of the windings 14 and then molding the carcass segments over the wound bladder 12 to produce a uniform spherical layer of material. The material of the carcass 16 can also be injected, or otherwise inserted, within a mold to form the carcass 16. It is common for a portion of the carcass 16 material to impregnate, bond to, or otherwise engage the layer of windings 14. The carcass 16 is made of an elastic material, preferably, a latex. Alternatively, the carcass 16 can be made of other materials such as a butyl rubber, a natural rubber, a synthetic polymeric plastic material, or other elastomeric material. In another alternative embodiment, the carcass 16 can be a multi-layered body including one or more layers of fabric or elastomeric material.

In one preferred embodiment, the carcass 16 is formed with a first set of inwardly extending channels 24. The first set of channels 24 defines a plurality of cover attachment regions 26 about an outer surface 28 of the carcass 16. In one preferred embodiment, the carcass 16 defines at least two, and less than or equal to sixteen, cover attachment regions 26. In particularly preferred embodiments, the carcass defines eight, ten or twelve cover attachment regions 26. Each cover attachment region 26 is configured to receive at least one cover panel 30. In alternative embodiments, the carcass can be formed without a first set of channels. In another alternative embodiment, the carcass can be formed with a set of outwardly extending ribs in lieu of the first set of channels. The first set of channels or ribs can define a pattern resembling the pattern of channels or ribs found on a conventional basketball. Alternatively, other pattern layouts can also be used.

The cover assembly 18 is preferably comprised of a plurality of cover panels 30. In one preferred embodiment, the cover assembly 18 includes at least two cover panels and less than or equal to sixteen cover panels. In particularly preferred embodiments, the cover assembly 18 includes eight, ten or twelve cover panels 30. The cover panels 30 are single or multi-layered sheets of material that are coupled to the cover attachment regions 26 of the carcass 16. Preferably, the cover panels 30 are laminated to the cover attachment regions 26 of the carcass 16. Alternatively, the cover panels 26 can be attached to the carcass 16 by other means, such as, for example, stitching, molding, pressing, bonding, and combinations thereof. The cover assembly 18 is configured for impact with one or more playing surfaces and for contact with players. In an alternative preferred embodiment, the cover assembly 18 can be connected directly to the bladder 12 or to the layer of windings 14.

In another alternative preferred embodiment, the carcass includes a first set of outwardly projecting ribs defining a first pattern, and the cover panels are skived or otherwise configured to engage the ribs. The skived cover panels in combination with the projecting ribs can define a set of grooves in the outer surface of the basketball.

Referring to FIG. 4, in one preferred embodiment, the outer surface of the cover assembly 18 including any channeled or recessed areas has a relatively smooth, non-pebbled surface. Referring to FIG. 5, in an alternative preferred embodiment, the outer surface of the cover assembly 18, including channeled or recessed areas, can have a pebbled surface. In other alternative preferred embodiments, the channeled or recessed areas of the cover assembly 18 can have a smooth outer surface and the remaining areas of the cover assembly 18 can have a pebbled surface. The opposite arrangement and combinations thereof are also contemplated. FIG. 5 shows random shaped pebbles. Alternatively, other shapes for the pebbled surface can also be used.

Figure 6:
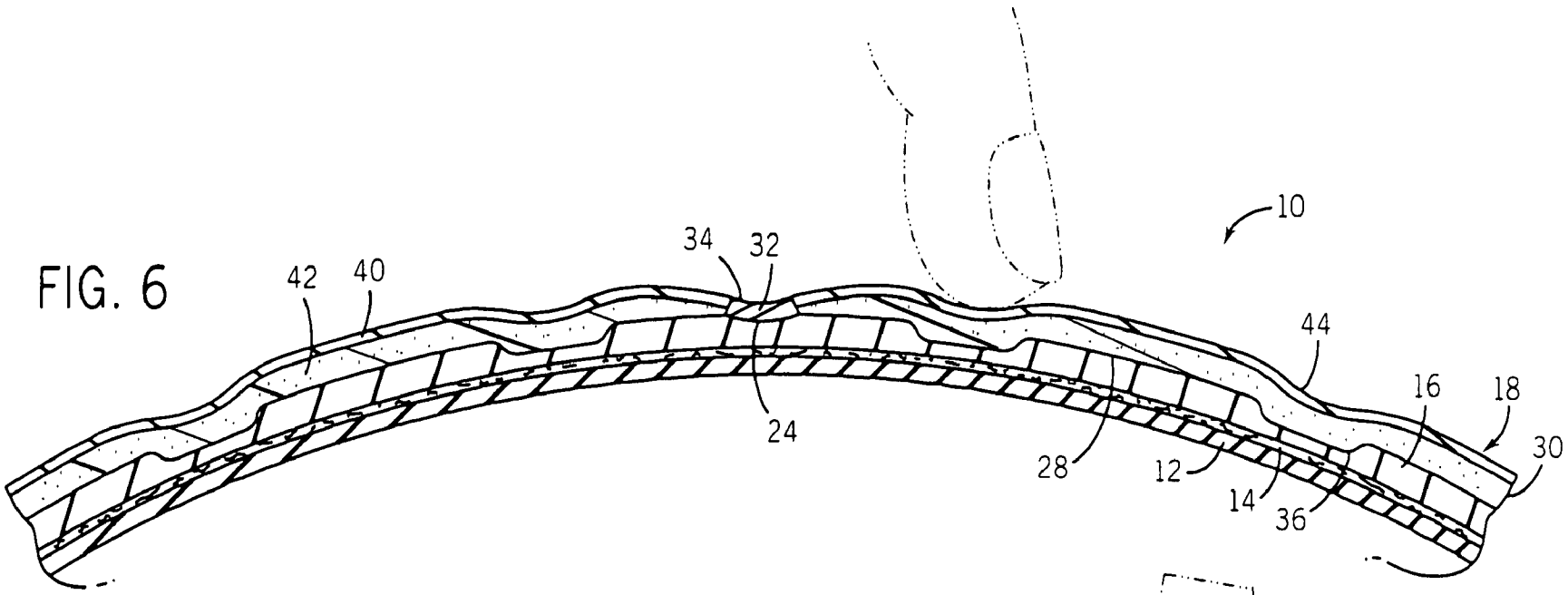
FIG. 6 is a sectional view of the basketball taken along line 6-6 of FIG. 2.

Referring to FIGS. 3 and 6, one preferred embodiment of the present invention is shown in greater detail. The bladder 12 is the inner most layer of the basketball 10. The bladder 12 is surrounded by the layer of windings 14. The carcass 16 is formed over the wound bladder. The carcass 16 defines the first set of channels 24. The first set of channels 24 can take the shape of a conventional basketball or can follow alternate patterns across the outer surface of the carcass 16. In one embodiment, a channel inlay 32 can be placed over the outer surface 28 of the carcass 16 at the first set of channels 24. The channel inlay 32 is an elongate strip of material used to cover the first set of channels 24 of the carcass and to form a first set of grooves 34 in the outer surface of the basketball 10. The channel inlays 32 are preferably laminated to the outer surface 28 of the carcass 16 at the first set of channels 24. Alternatively, the channel inlays 32 can by thermally bonded, chemically bonded, stitched, molded or otherwise attached to the outer surface of the carcass 16. In another alternative embodiment, the channel inlay 32 can be formed as part of a cover panel. In another alternative preferred embodiment, the first set of channels can be replaced by a first set of raised projections, thereby eliminating the need for a channel inlay. The raised projections in the carcass can form the first set of channels in the outer surface of the basketball.

The carcass 16 also defines a second set of channels 36 formed into the outer surface 28 of the carcass 16. Each of the second set of channels 36 are elongate recesses extending at or near a first reference point on the basketball 10 to at or near a second reference point on the basketball 10. The second set of channels 36 are preferably spaced apart from each other, and non-interconnected from the first set of channels 24. In alternative preferred embodiments, the second set of channels can be formed in a variety of different shapes. For example, the second set of channels can be formed as line segments, curved segments, circles, other closed curved paths or combinations thereof. In other alternative embodiments, the second set of channels can be interconnected to each other and/or to the first set of channels. The second set of channels 36 number from at least two channels to less than or equal to forty channels. In one preferred embodiment, the second set of channels 36 number from at least eight to less than or equal to twenty-four channels. In the embodiment shown in FIGS. 1-6, the second set of channels 36 number twenty-four. Accordingly, three channels of the second set of channels 36 correspond to a single cover attachment region 26 of the carcass 16.

Preferably, the depth of the second set of channels 36 is greater than or equal to 0.7 mm and less than or equal to 10 mm, and the width of the second set of channels 36 is greater than or equal to 2 mm and less than or equal to 20 mm. In preferred embodiments, the depth of the second set of channels can be equal to or greater than 0.7 mm and less than or equal to 4 mm, and the width of the second set of channels 36 is greater than or equal to 4 mm and less than or equal to 8 mm. In one particularly preferred embodiment, the depth of the second set of channels is greater than or equal to 1.0 mm and less than or equal to 1.3 mm, and the width is greater than or equal to 5 mm and less than or equal to 6 mm. The second set of channels 36 are preferably sized to approximate the size of the first set of channels 24. The second set of channels 36 is also preferably sized to receive or accommodate a portion of a user's fingertips.

The cross-sectional shape of the second set of channels 36 can also vary. The overall shape cross-sectional shape can be semi-circular, arcuate, generally semi-rectangular, or other shapes. The edges or transitions of the channels can be rounded to reduce stress concentrations in the outer surface of the carcass 16.

Referring to FIG. 6, the cover panels 30 comprising the cover assembly 18 each include an outer layer 40 coupled to a backing 42. The outer layer 40 is formed or applied to the backing 42 such that a portion of the outer layer 40 impregnates, extends into, or otherwise engages the backing 42. Alternatively, the outer layer 40 can be attached to the backing 42 through an adhesive, bonding, stitching, or other conventional means. The outer layer is formed of a wear resistance, resilient material having a high coefficient of friction values (or a high level of grippability). The material used to produce the outer layer 40 can be a natural rubber, a butyl rubber, natural leather, synthetic leather, a polyurethane, a thermoplastic material, a thermoset material, or other synthetic polymeric materials. The grooves and/or ridges of the cover panels are preferably formed without a Velcro® type material (or hook and loop type material). Further, the basketball 10 of the present invention is configured for interaction with a user's ungloved hands. Use of gloves with the basketball of the present invention is not required or preferred.

The backing 42 is configured to increase the tensile strength of the cover panels 30. The backing 30 is made of a soft material, preferably a felt-like fabric. Alternatively, the backing 30 can be formed of other materials, such as, for example, other woven or unwoven fabrics, plastic, an elastomer, a rubber, and combinations thereof. The backing 30 is preferably configured to contact the outer surface of the carcass 16. In an alternative preferred embodiment, the cover panels 18 can be formed without a backing.

Each cover panel 30 preferably extends over at least one channel of the second set of channels 36 of the carcass 16. The cover panels 30 are configured to be relatively thin and to generally conform to the shape of the outer surface 28 of the carcass 16. Accordingly, the cover panels 30 define a set of grooves 44 in the outer surface of the basketball 10 that correspond to the second set of channels 36. Each of the grooves 44 are elongate recesses formed into the outer surface of the basketball 10. The grooves 44 can extend from at or near a first reference point 46 (see FIG. 1) on the basketball 10 to at or near a second reference point 48 (see FIG. 1) on the basketball 10. The grooves 44 are preferably spaced apart from each other and from the first set of channels 24. In alternative embodiments, the grooves can be interconnected to each other and/or to the first set of channels. The grooves 44 can number from at least two channels to less than or equal to forty channels. In one preferred embodiment, the grooves 44 number from at least eight to less than or equal to twenty-four channels. In the embodiment shown in FIGS. 1-6, the grooves 44 number twenty-four. Accordingly, three grooves 44 are formed into each cover panel 30 that directly correspond to the three channels of the second set of channels 36 formed in the outer surface 28 of the carcass 16. In alternative preferred embodiments, the grooves can be formed in a variety of shapes including line segments, curved segments, circles, other closed curved paths and combinations thereof.

Preferably, the depth of the grooves 44 is greater than or equal to 0.7 mm and less than or equal to 10 mm, and the width of the grooves is greater than or equal to 2 mm and less than or equal to 20 mm. In preferred embodiments, the depth of the grooves 44 can be equal to or greater than 0.7 mm and less than or equal to 4 mm, and the width of the grooves can be greater than or equal to 4 mm and less than or equal to 8 mm. In one particularly preferred embodiment, the depth of the grooves 44 is greater than or equal to 1.0 mm and less than or equal to 1.3 mm, and the width is greater than or equal to 5 mm and less than or equal to 6 mm. The grooves 44 are preferably sized to approximate the size of the second set of channels 36 and/or the first set of channels 24. The grooves 44 are also preferably sized to receive or accommodate a portion of a user's fingertips.

Figure 7:
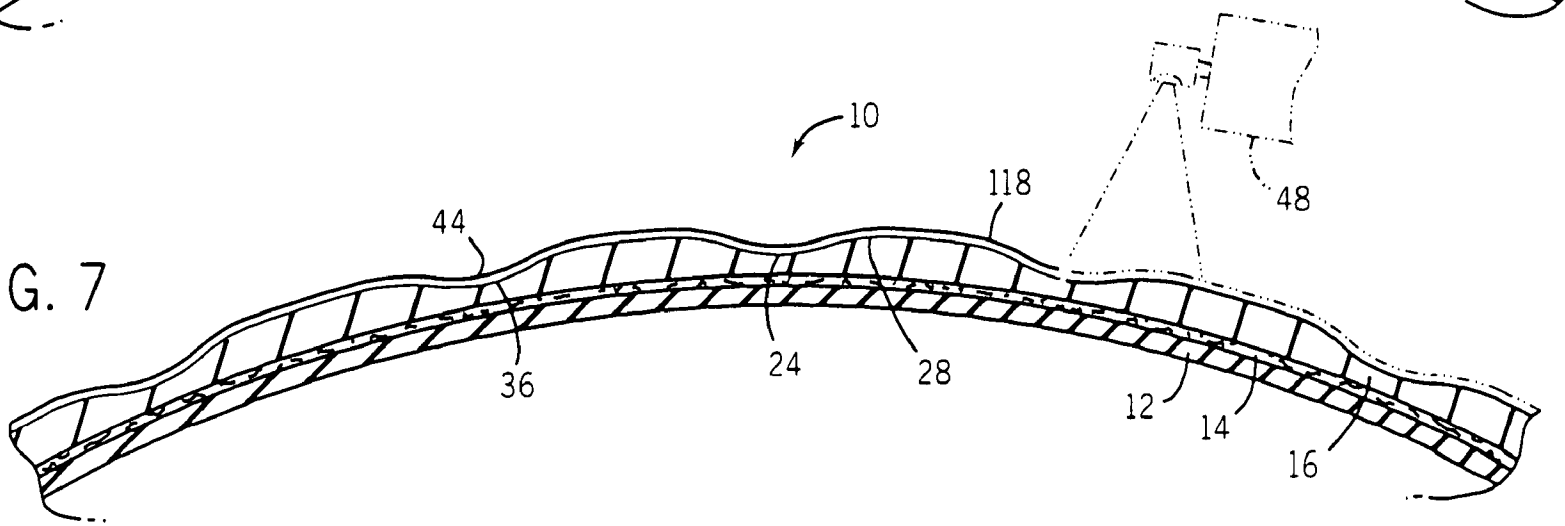
FIG. 7 is a sectional view of the basketball taken along line 6-6 of FIG. 2 in accordance with another alternative preferred embodiment of the present invention.

Referring to FIG. 7, an alternative preferred embodiment of the present invention is illustrated. The bladder 12, the layer of windings 14 and the carcass 16 are the substantially the same as described above. The cover assembly 118 differs from the cover assembly 18 above in that the cover assembly 118 comprises one or more thin layers or coatings of material (s). Channel inlays are typically not used. The cover assembly 118 can be sprayed-on, painted-on, electro-statically painted-on, brushed-on, dipped-on or applied through various combinations of the above listed techniques, or other similar techniques. The cover assembly 118 is preferably bonded to the outer surface 28 of the carcass 16 without the use of a separate adhesive or adhesive agent. The cover assembly 118 can be sprayed, in liquid form, onto the interior surface of each of mold cavities or to the outer surface 28 of the carcass 16 by a sprayer 48. In alternative preferred embodiments, the cover material can be applied in liquid form to the interior surface of the mold cavities or to the outer surface of the carcass by other means, such as, for example, painting, brushing, or pouring. In alternative preferred embodiments, the cover material can be a powder or formed as pellets that are poured into, or otherwise inserted within, the mold cavities. In another preferred embodiment, the cover material can be injected, in liquid form, into the closed mold including the carcass.

The cover assembly 118 is preferably a single layer of material covering the entire carcass 16 of the basketball 10. Alternatively, the cover assembly 118 can include two or more layers of material applied to the carcass. The cover assembly 118 has a thickness of at least 0.1 mm and less than or equal to 2.0 mm. In a preferred embodiment, the thickness of the cover between 0.1 mm and 0.75 mm. In yet another particularly preferred embodiment, the thickness of the cover is less than 0.5 mm.

The cover assembly 118 generally conforms to the shape of the outer surface 28 of the carcass 16. Accordingly, the outer surface of the cover assembly 118 will include the grooves 44 as well as other contours representative of the first set of channels 24 as well as any pebbling or other feature applied to the outer surface 28 of the carcass 16. The cover assembly 118 of the completed ball is preferably a one piece, unitary layer, which substantially surrounds or covers the outer surface 28 of the carcass 16. In alternative preferred embodiments, the cover assembly 118 can be formed in two or more separate pieces.

The cover assembly 118 can be formed of any suitable material that can cure, set, or harden on the carcass 16 (or other internal structural component of the basketball) to provide desirable properties of grip, feel, and durability. Urethane and plastic materials are particularly advantageous. Other materials can also be used, such as, for example, a wet process polyurethane, a coagulated polyurethane, a dry process polyurethane, rubber, synthetic rubber and other elastomers.

Figure 8:
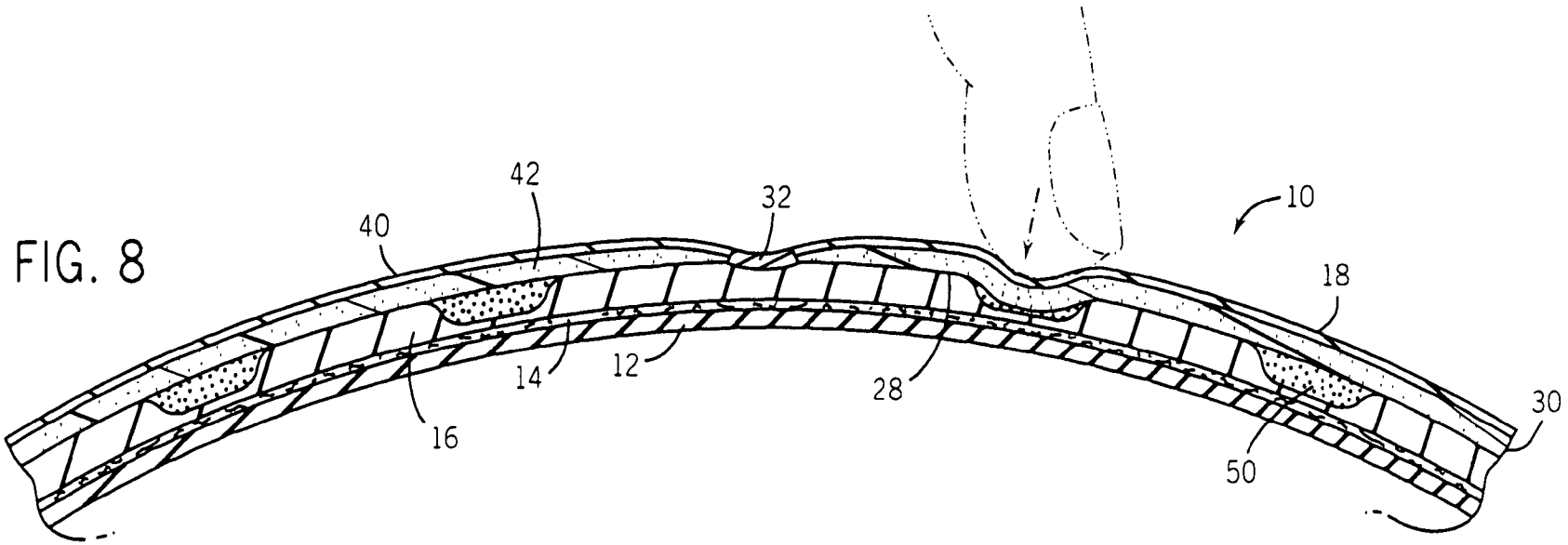
FIGS. 8 through 16 are sectional views of a basketball in accordance with other alternative preferred embodiments of the present invention.
Figure 9:
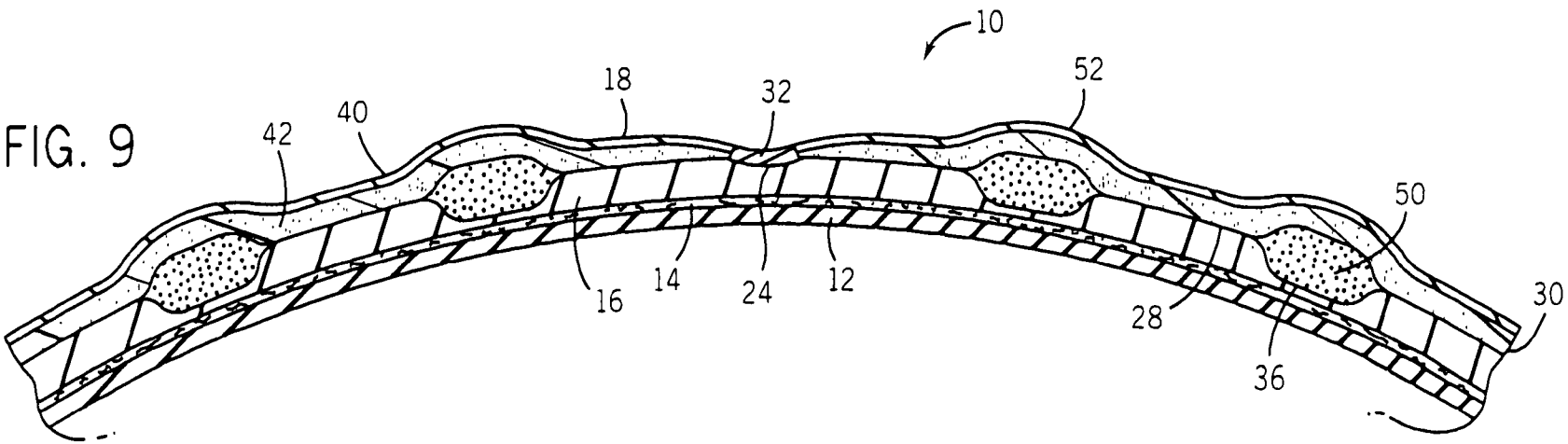

Referring to FIGS. 8 and 9, additional alternative preferred embodiments of the present invention are illustrated. The bladder 12, the layer of windings 14, the carcass 16 and the cover assembly 18 are substantially the same as described above in relation to FIGS. 1 through 6. In the alternative preferred embodiments of FIGS. 8 and 9, an insert 50 is disposed within the second set of channels 36 between the carcass 16 and the cover assembly 18. The insert 50 is preferably formed of a one or more highly compressible materials or a compressible structure. The compressible insert 50 can be formed of a resilient polymer, a porous elastomer, a sponge, a foam, a porous rubber and combinations thereof. The compressible insert 50 can take the form of a strip of material. Alternatively, the compressible insert 50 can comprise one or more tubes or other hollow structures that can be un-filled or fluid-filled.

Referring to FIG. 8, the insert 50 fills at least a portion of the second set of channels 36. Preferably, the insert 50 fills the second set of channels 36 such that the outer surface of the cover panels 30 maintain a generally spherical shaped, spaced apart by the first set of channels 24. The compressible insert 50 is configured to compress and deflect inward when a user contacts the outer surface of the basketball 10 above the second set of channels 44. Accordingly, a basketball 10, produced in accordance with the embodiment of FIG. 8, will have the appearance of a conventional basketball with only a first set of channels visible. However, when the user grasps the basketball of the embodiment of FIG. 8, any fingertips of the user placed on the cover panel 30 over the second set of channels 44 will cause the cover panel 30 to deflect inward thereby providing the user with the benefits and advantages of the second set of channels without the appearance of the second set of channels on the outer surface of the ball. The hardness of the material used to form the compressible insert 50 is less or lower than the hardness of the material used to form the outer surface of the carcass 16.

In alternative preferred embodiments, the insert 50 can be formed of a material with a hardness that is greater than the hardness of the material used to form the outer surface of the carcass. In this alternative embodiment, the area between the inserts is more easily compressible than the area corresponding to the insert.

Referring to FIG. 9, the insert 50 can be sized to project outward beyond the depth of the second set of channels 36 and beyond the outer surface 28 of the carcass. The inserts 50 can be formed so as to cause the cover panels 30 of the cover assembly 18 to deflect outward at the location of the inserts 50, thereby forming a plurality of ridges 52 corresponding to the location of the second set of channels 44. The thickness, size, hardness and compressibility of the compressible inserts 50 can be varied to produce the desired height, size and compressibility of the ridges 52.

In alternative preferred embodiments, the inserts can be formed of a compressible material or a stiffer less compressible material. The inserts can be applied to the outer surface of a carcass formed without a second set of channels, or to another intermediate internal basketball structure. Such inserts can take the form of strips of material or intermediate panels. The spacing and arrangement of the inserts between the carcass and the cover panels can result in the formation of a plurality of grooves and/or a plurality of ridges in the outer surface of the basketball.

Figure 10:
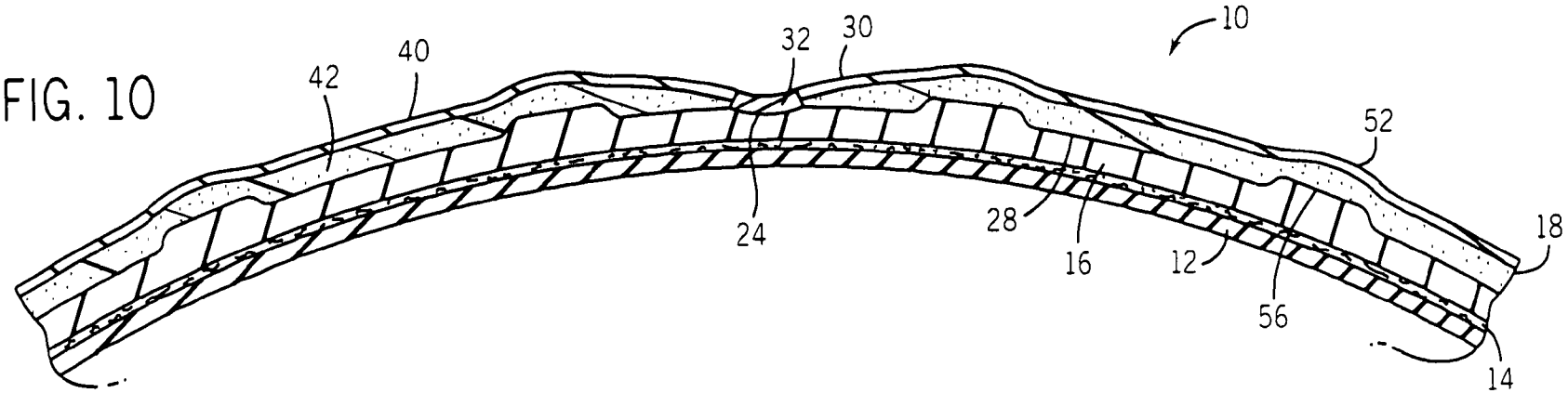

Referring to FIG. 10, another alternative preferred embodiment of the present invention is illustrated. The bladder 12, the layer of windings 14 and the cover assembly 18 are substantially the same as described above in relation to the embodiment of FIGS. 1-6. The carcass 116 is similar to the carcass 16 with exception of the carcass 116 being formed with a plurality of outwardly extending ribs 56. The ribs 56 are elongate projections extending at or near a first reference point on the basketball 10 to at or near a second reference point on the basketball 10. The ribs 56 are preferably spaced apart from each other and from the first set of channels 24. In alternative embodiments, the ribs 56 can be interconnected to each other and/or to the first set of channels. The ribs 56 can also be shaped in a variety of different shapes, such as line segments, curved segments, circles, other closed curved paths and combinations thereof. The ribs 56 number from at least two to less than or equal to forty. In one preferred embodiment, the ribs 56 number from at least eight to less than or equal to twenty-four. In one preferred embodiment, the ribs 56 number twenty-four. Accordingly, three ribs 56 correspond to a single cover attachment region 26 of the carcass 16. Alternatively, one, two or four ribs can be formed to correspond with each cover attachment region 26.

Preferably, the height of the ribs 56 is greater than or equal to 0.7 mm and less than or equal to 10 mm with respect to other portions of the cover layer and/or with respect to the outer surface of the basketball. The width of the ribs 56 is greater than or equal to 2 mm and less than or equal to 20 mm. In preferred embodiments, the height of the ribs 56 can be equal to or greater than 0.5 mm and less than or equal to 4 mm, and the width of the ribs 56 is greater than or equal to 4 mm and less than or equal to 8 mm. In one particularly preferred embodiment, the height of the ribs 56 is greater than or equal to 1.0 mm and less than or equal to 1.3 mm, and the width is greater than or equal to 5 mm and less than or equal to 6 mm. The cross-sectional shape of the ribs 56 can also vary. The overall shape cross-sectional shape can be semi-circular, arcuate, generally semi-rectangular, or other shapes. The edges or transitions of the ribs 56 can be rounded to reduce stress concentrations in the outer surface of the carcass 16.

Because the cover panels 30 of the cover assembly 18 are configured to generally conform to the contour of the outer surface 28 of the carcass 16, the ribs 56 produce a corresponding set of elongate ridges 52 on the outer surface of the basketball 10. The shape of the ridges 52 generally correspond to the shape of the ribs 56. The thickness and flexibility of the cover panels 30 contribute to the degree in which the shape of the ridges 52 correspond to the shape of the ribs 56. In alternative preferred embodiments, the basketball can be formed with one or more grooves and one or more ridges.

Figure 11:
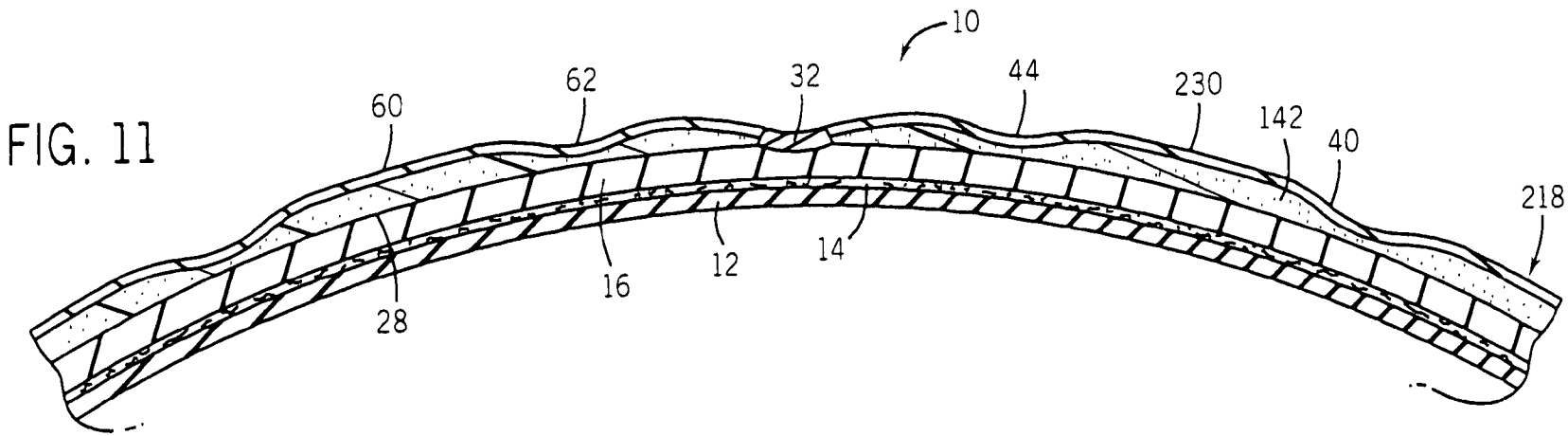
Figure 12:
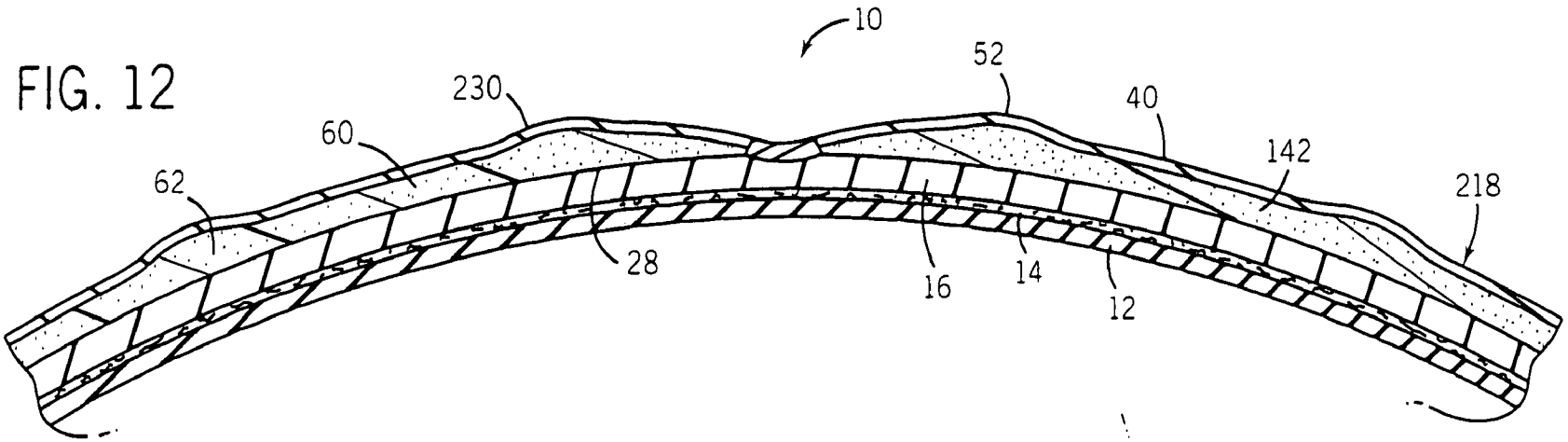

Referring to FIGS. 11 and 12, an alternative preferred embodiment of the present invention is illustrated. The bladder 12 and the layer of windings 14 are substantially the same as described above with respect to the embodiment of FIG. 1-6. The carcass 16 is also substantially the same as described above except that the carcass 16 does not include the second set of channels or a plurality of ribs. The cover assembly 218 is similar to the cover assembly 18 described above. The cover assembly 218 includes at least one cover panel 230. The cover panel 230 has a first region 60 of having a generally uniform first thickness and a plurality of spaced-apart, non-interconnected second regions 62 having an average second thickness that is different from the first thickness. Preferably, the cover panel 230 includes the outer layer 40 and a backing 142. The backing 142 is substantially similar to the backing 42 described above. Alternatively, the cover panel 230 can be formed of a single layer of material or three or more layers of material.

Referring to FIG. 11, the average second thickness of the second region 62 of the cover panel 230 is less than the first thickness of the first region 60 such that the second regions 62 in combination with the first region 60 define a plurality of grooves 44 in outer surface of the basketball 10. In one embodiment, the first thickness is equal to or greater than 1.0 mm and less than or equal to 15 mm, and the second thickness is equal to or greater than 0.1 mm and less than or equal to 10 mm. The plurality of second regions 62 relative to the first region 60 define a second set of channels 124 in the cover panel 230. The difference between the first thickness and the second thickness is at least 0.7 mm.

In one preferred embodiment, the variations in thickness of the cover panel 230 result from variations in the thickness of the backing 142. The variation in thickness of the backing 142 can produce a second set of channels on the inner or outer surface of the backing 142. Preferably, the second set of channels are defined in the inner surface of the backing 142. When the backing 142 having the second set of channels is applied to the outer surface of the carcass 216, the second set of channels produce the plurality of grooves 44 in the outer surface of the basketball 10.

Referring to FIG. 12, in another alternative preferred embodiment, the average second thickness of the second region 62 of the cover panel 230 is greater than the first thickness of the first region 60 such that the second regions 62 in combination with the first region 60 define a plurality of outwardly projecting ridges 52 upon the outer surface of the basketball 10. In one embodiment, the first thickness is equal to or greater than 0.1 mm and less than or equal to 10 mm, and the second thickness is equal to or greater than 1.0 mm and less than or equal to 15 mm. The difference between the first thickness and the second thickness is at least 0.3 mm, and can extend up to 10 mm or greater. In other alternative embodiments, the height of the ridges can be equal or greater than 0.3 mm and less than or equal to 10 mm, or equal to or greater than 0.6 mm and less than or equal to 7 mm. In one preferred embodiment, the ridges 52 can be produced by variations in the thickness of the backing 142. Alternatively, the outer layer or additional components of the cover layer may produce the ridges.

Figure 13:
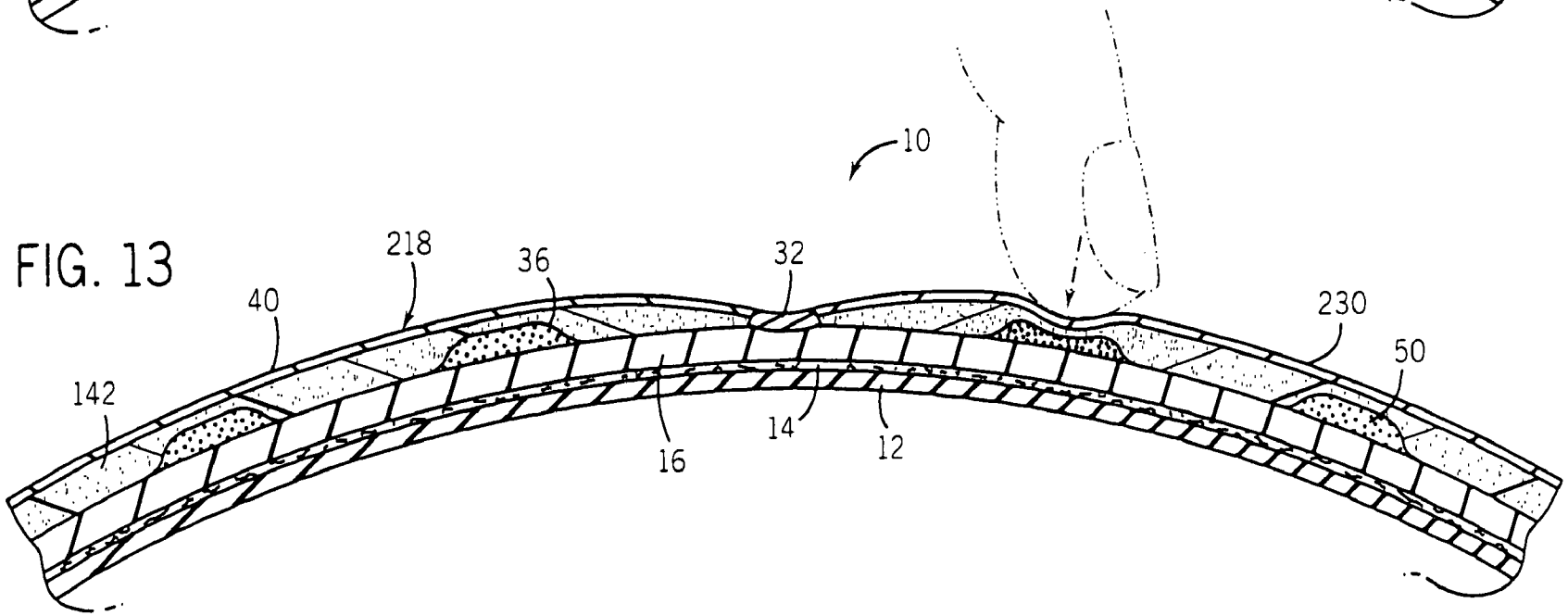
Figure 14:
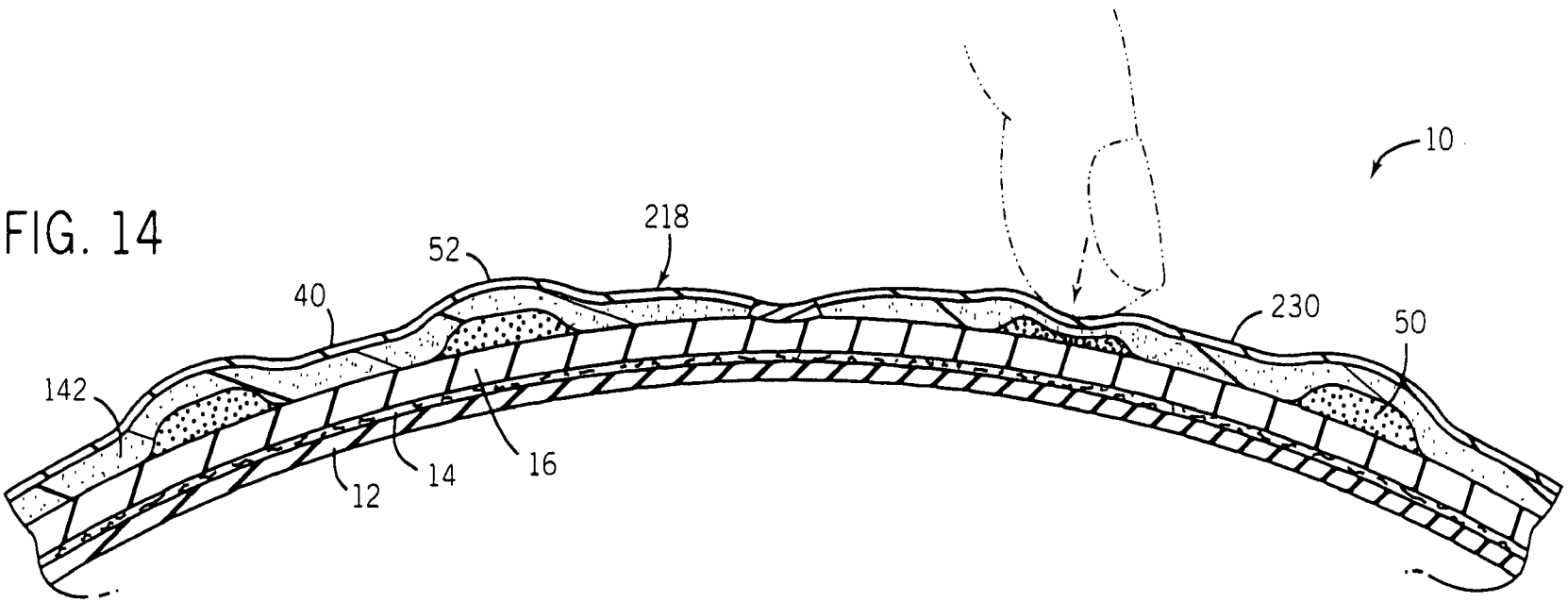

Referring to FIGS. 13 and 14, other alternative preferred embodiments of the present invention are illustrated. The bladder 12, the layer of windings 14, the carcass 16 and the cover layer 230 are substantially the same as described above with respect to the embodiment of FIG. 11. The cover layer 230 defines the second set of channels 36. Preferably, the backing 142 of the cover layer 230 defines the second set of channels 36. Alternatively, the cover panel as a whole, or other components of the cover panel, may define the second set of channels. The insert 50 is disposed within the second set of channels 36 between the carcass 16 and the cover layer 230. The insert 50 is substantially the same as described above. The compressible insert 50 fills at least a portion of the second set of channels 36. Preferably, the compressible insert 50 fills the second set of channels 36 such that the outer surface of the cover panels 230 maintain a generally spherical shaped, spaced apart by the first set of channels 24. The compressible insert 50 is configured to compress and deflect inward when a user contacts the outer surface of the basketball 10 above the second set of channels 36. Accordingly, a basketball 10, produced in accordance with the embodiment of FIG. 7, will have the appearance of a conventional basketball with only a first set of channels visible. However, when the user grasps the basketball of the embodiment of FIG. 13, any fingertips of the user placed on the cover panel 230 over the second set of channels 36 will cause the cover panel 230 to deflect inward thereby providing the user with the benefits and advantages of the second set of channels without the appearance of the second set of channels on the outer surface of the ball.

Referring to FIG. 14, the insert 50 can be sized to cause the cover panels 230 to project outward, thereby forming a plurality of ridges 52 corresponding to the location of the second set of channels 36. The thickness, size, hardness and compressibility of the inserts 50 can be varied to produce the desired height, size and compressibility of the ridges 52. As described above, in alternative embodiments, the inserts can be formed of less compressible material so as to produce stiffened ridges in the outer surface of the game ball or to produce regions of decreased flexibility in the outer surface of the basketball. Alternatively, the inserts can be disposed between the carcass and the cover panel without channels formed in the cover panel thereby producing ridges and/or grooves in the outer surface of the basketball.

Figure 15:
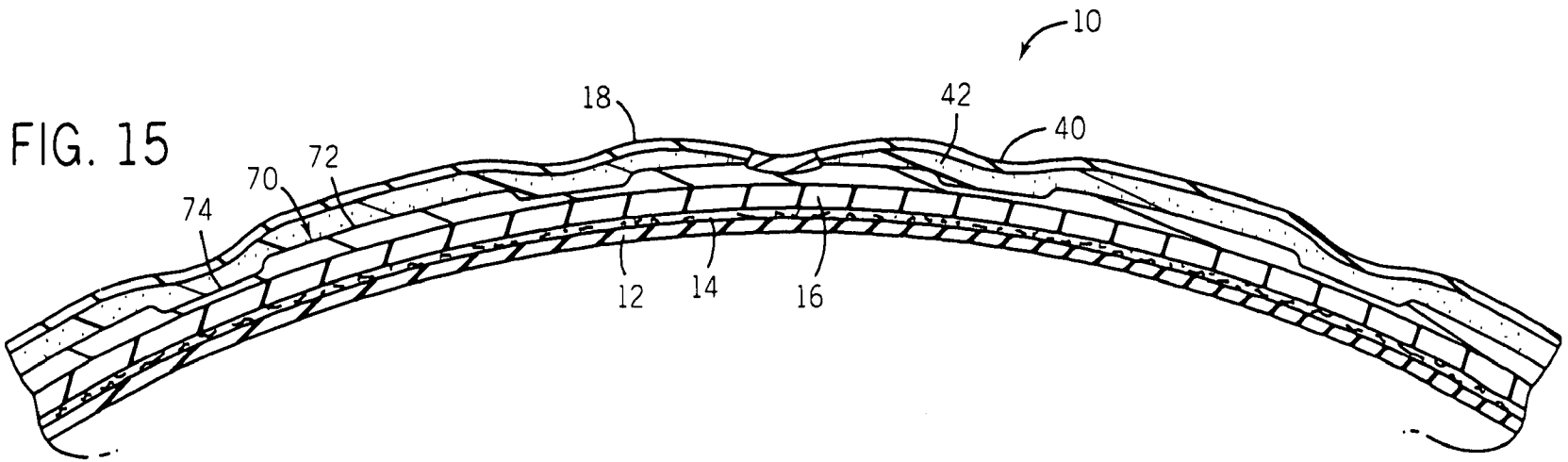
Figure 16:
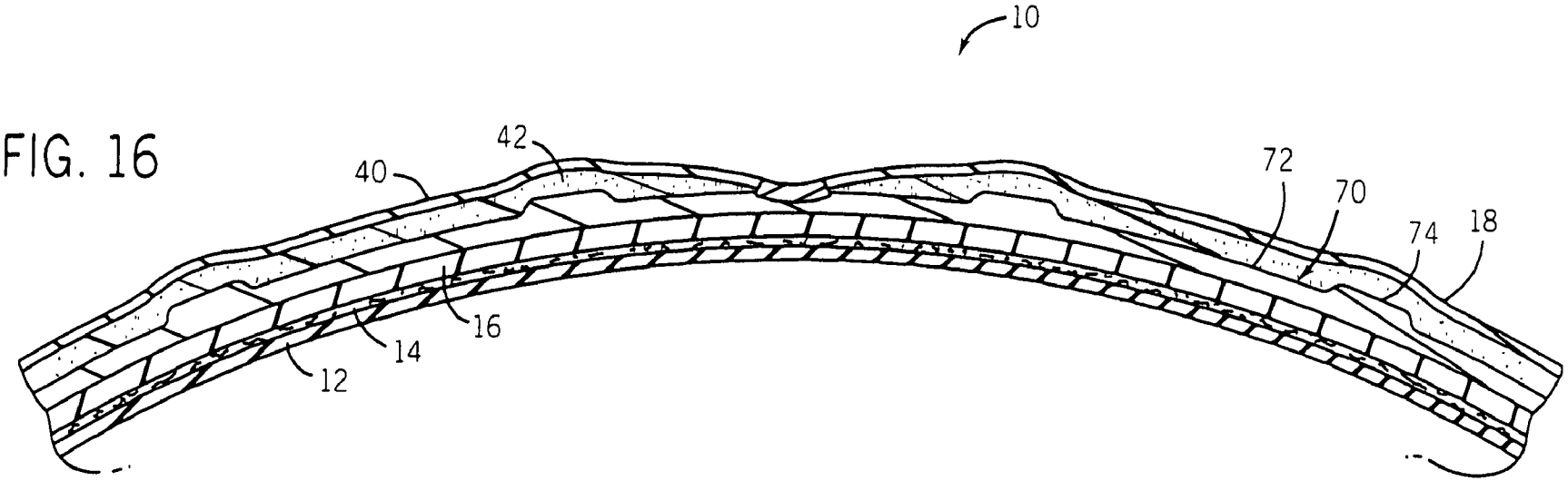
Figure 17:
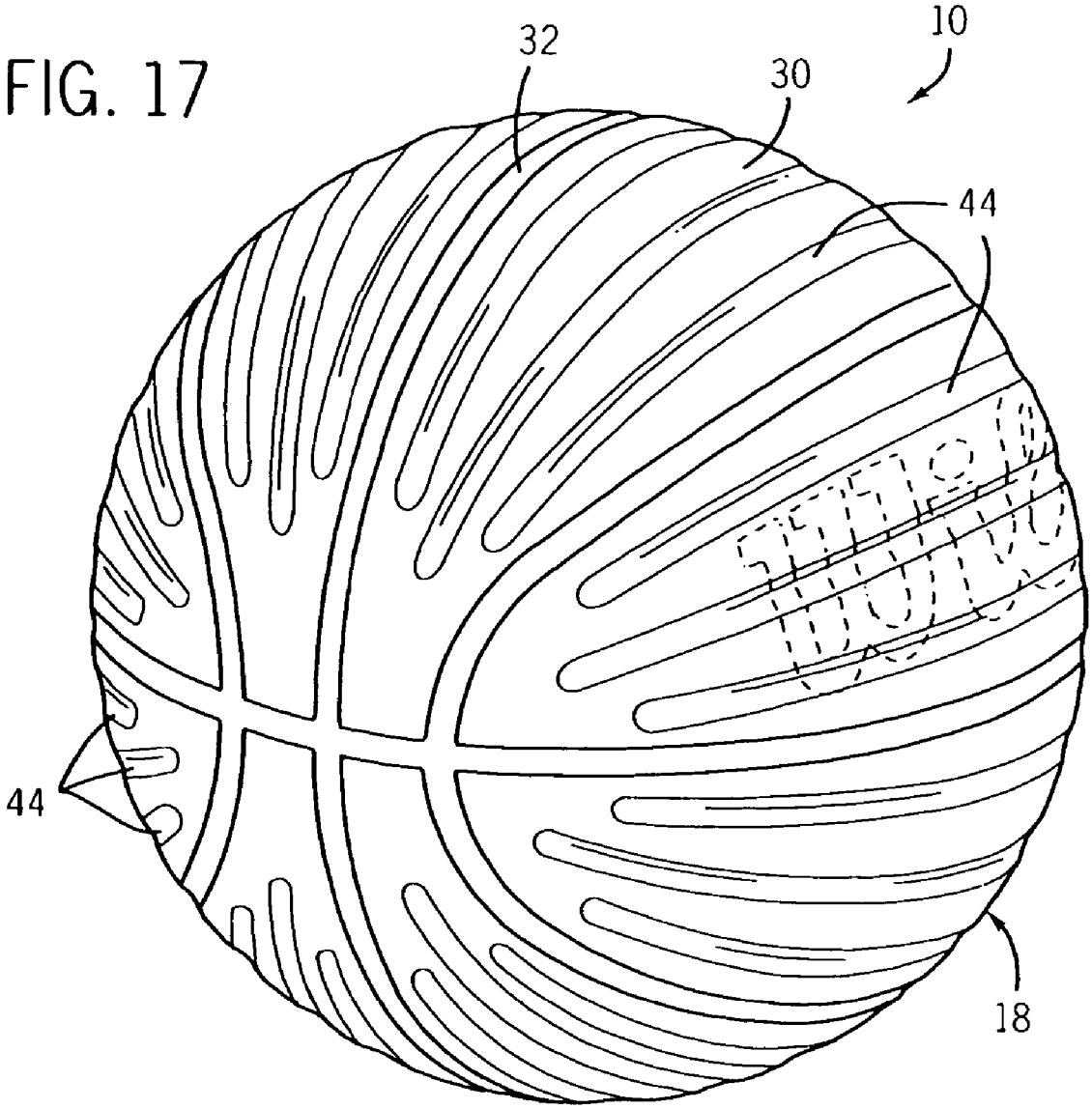
FIG. 17 is a side perspective view of the basketball of FIG. 1.

Referring to FIGS. 15 and 16, in other alternative preferred embodiments, the basketball 10 can also include at least one intermediate panel 70 having an outer surface and positioned over the carcass 16 and beneath the cover assembly 18. Each cover panel 30 may extend over a separate intermediate panel. Alternatively, a single intermediate panel or multiple intermediate panels can be applied to the basketball 10 between the carcass and the cover assembly. The bladder 12, the layer of windings 14 and the cover assembly 18 are substantially the same as described above with respect to the embodiment of FIG. 1-6. The carcass 16 is also substantially the same as described above with except that the carcass 16 does not include the second set of channels or a plurality of ribs.

The intermediate panel can be a strip of material used to form grooves and/or ridges in the outer surface of the basketball. In a preferred embodiment, the intermediate panel 70 has a first region 72 having a generally uniform first thickness and a plurality of second regions 74 having an average second thickness that is different from the first thickness. The intermediate panel 70 is formed of a resilient material such as a textile, a non-woven fabric, a rubber, an elastomer, as sponge, a plastic, a polyurethane, other polymeric material and combinations thereof. The plurality of second regions is preferably spaced-apart and non-interconnected to each other. Alternatively, the second regions can be interconnected.

Referring to FIG. 15, the average second thickness of the second region 74 of the intermediate panel 70 is less than the first thickness of the first region 72 such that the second regions 74 in combination with the first region 72 define a second set of channels 36. In one embodiment, the first thickness is equal to or greater than 1.0 mm and less than or equal to 15 mm, and the second thickness is equal to or greater than 0.1 mm and less than or equal to 10 mm. The difference between the first and second thickness is at least 0.7 mm. The cover panel 30 generally conforms to the outer surface of the intermediate panel 70 to produce the grooves 44 in the outer surface of the basketball 10. The second set of channels and the grooves are the same as described above.

Referring to FIG. 16, in another alternative preferred embodiment, the average second thickness of the second region 74 of the intermediate panel 70 is greater than the first thickness of the first region 72 such that the second regions 74 in combination with the first region 72 define a plurality of outwardly projecting ribs 56 upon the outer surface of intermediate panel 70. The cover panel 30 generally conforms to the outer surface of the intermediate panel 70 to produce the outwardly projecting ridges 52 in the outer surface of the basketball 10. In one embodiment, the first thickness is equal to or greater than 0.1 mm and less than or equal to 10 mm, and the second thickness is equal to or greater than 1.0 mm and less than or equal to 15 mm. The difference between the first and second thickness is at least 0.7 mm.

Figure 21:
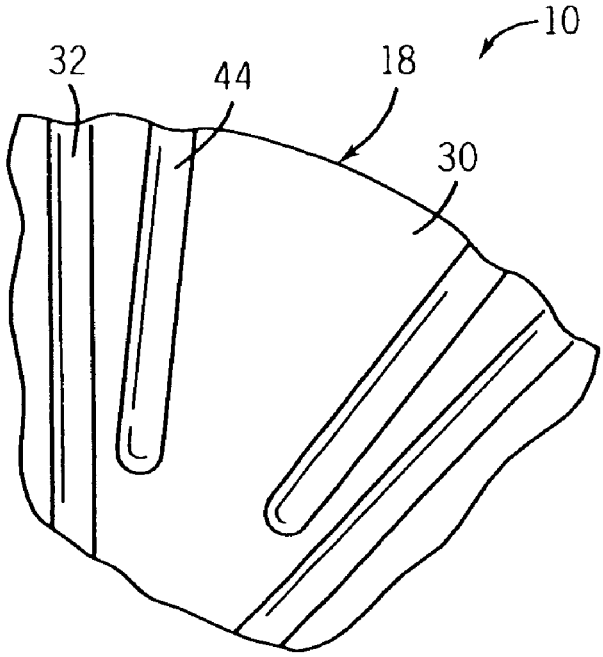
FIG. 21 is an enlarged view of a portion of the outer surface of a basketball in accordance with another alternative preferred embodiment of the present invention.
Figure 22:
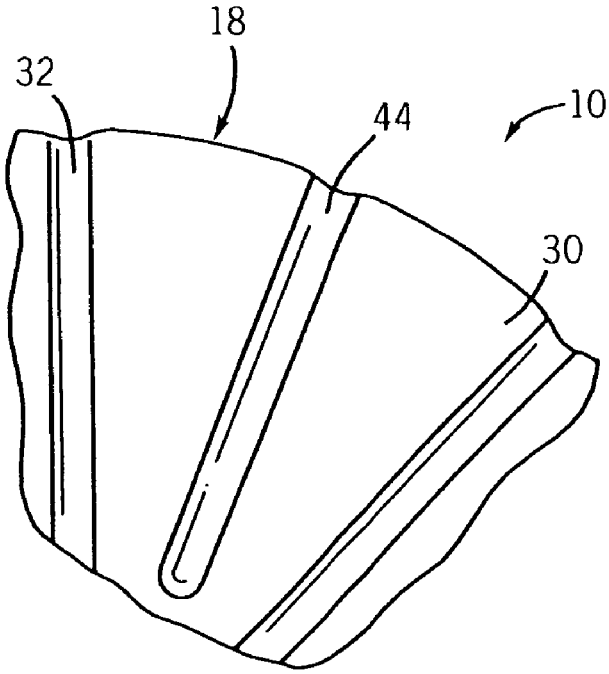
FIG. 22 is an enlarged view of a portion of the outer surface of a basketball in accordance with another alternative preferred embodiment of the present invention.
Figure 23:
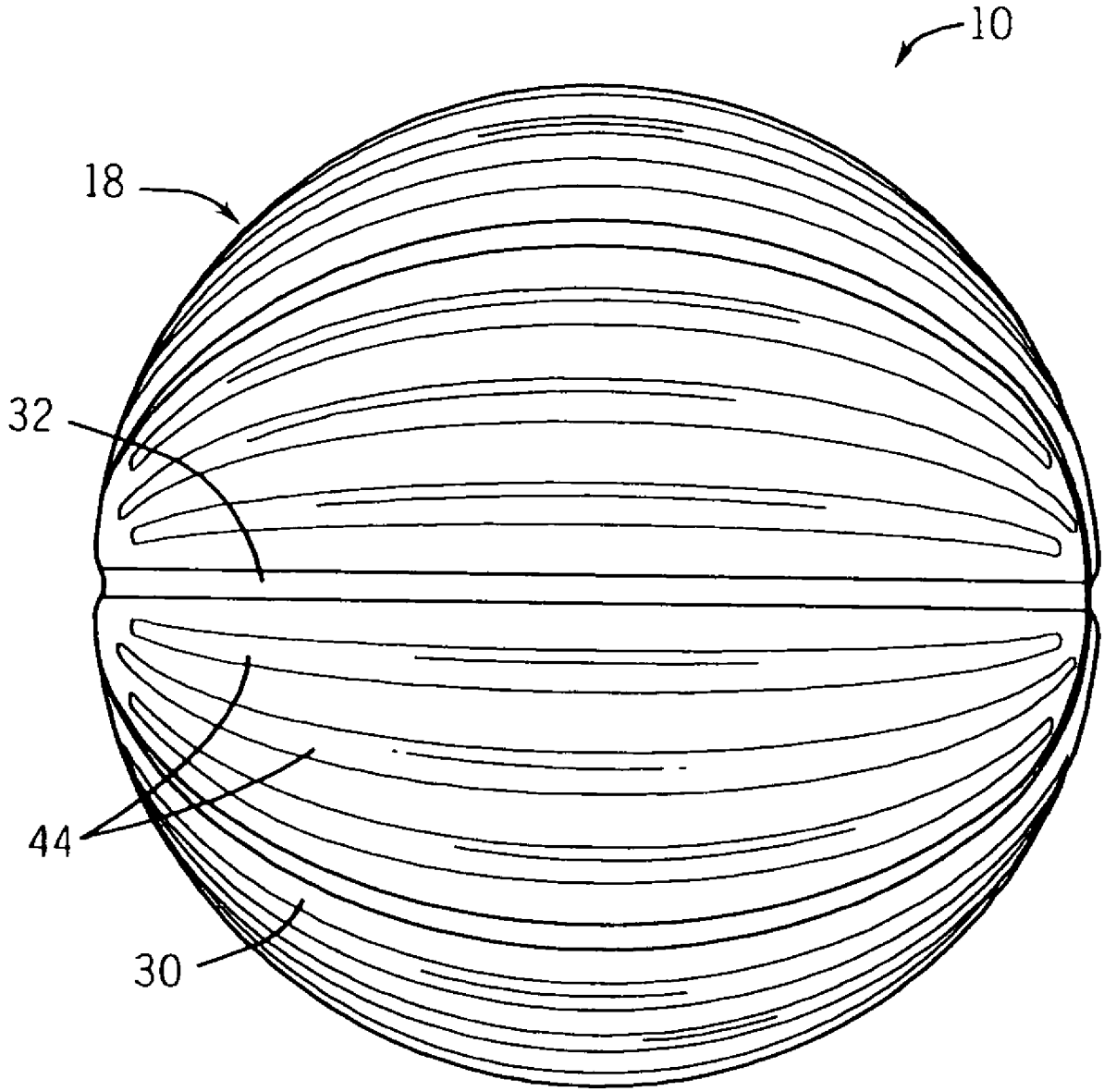
FIG. 23 is a rear view of the basketball of FIG. 1.

Referring to FIGS. 17 through 20 and FIG. 23, the basketball 10 having three grooves 44 defined in each cover panel 30, and configured in accordance with the present invention is shown. Referring to FIGS. 21 and 22, additional alternative preferred embodiments of the present invention are illustrated. The cover assembly 18 can be formed with one or more grooves defined into each cover panel 30 of the basketball 10. In FIG. 21, a single cover panel 30 is shown having two grooves 44 such that the basketball includes a total of sixteen grooves 44. In FIG. 22, a single cover panel 30 is shown having a single groove 44 such that the basketball includes a total of eight grooves 44. Alternatively, other numbers of grooves can also be defined into the outer surface of the basketball.

Many embodiments of the game balls, such as basketballs 10 and footballs 100 built in accordance with the present application, are specifically configured for providing optimum performance in one or more levels of competitive, organized play. For example, many embodiments of the basketballs built in accordance with the present application fully meet the basketball rules and/or requirements of one or more of the following basketball organizations: the Basketball Rules of the National Federation of State High School Associations ("NFHS"); the Basketball Rules and Interpretations of the National Collegiate Athletic Association ("NCAA"); and the Official Basketball Rules of the Federation International de Basketball Amateur ("FIBA"). Additionally, many embodiments of the footballs built in accordance with the present application fully meet the football rules and/or requirements of one or more of the following football organizations: the Football Rules of the National Federation of State High School Associations ("NFHS"); the Football Rules and Interpretations of the National Collegiate Athletic Association ("NCAA"); the Official Football Rules of the National Football League ("NFL") and the Football Leagues of Pop Warner Little Scholars, Inc. Accordingly, the term "basketball configured for organized, competitive play" or "football configured for organized, competitive play" refers to a basketball or football, respectively that fully meets the basketball or football rules and/or requirements of, and is fully functional for play in, one or more of the above listed organizations.

Basketballs built in accordance with the present invention enable a player to more quickly locate and orientate the basketball with his or her fingertips contacting one or more channels in the outer surface of the basketball prior to shooting. The additional grooves and/or the additional ridges included in the various embodiments of the present invention allow for the basketball to be easier to grasp with a single hand or with both hands. Basketballs built in accordance with the present invention can improve a player's ability to easily grasp, handle, pass, shoot, dribble and otherwise control the ball during use without radically departing from the ball's traditional design. The optimal positioning of the additional grooves and/or ridges further enhances the playability of the basketball. The additional grooves and/or ridges also facilitate a player's ability to impart spin on the ball during shooting. The improved maneuverability offered by the basketballs of the present invention can also assist in reducing turnovers. The basketballs are also well-suited for inclement weather or game conditions where players' perspiration can play a role in the ability to grasp and control a game ball. Further, basketballs built in accordance with the present invention provide an improved feel to the player, and also a unique appealing aesthetic. The improved gripability can also assist in reducing turnovers. The outer surface of the game ball is also well-suited for inclement weather or game conditions where players' perspiration can play a role in the ability to grasp and control a game ball.

Figure 24:
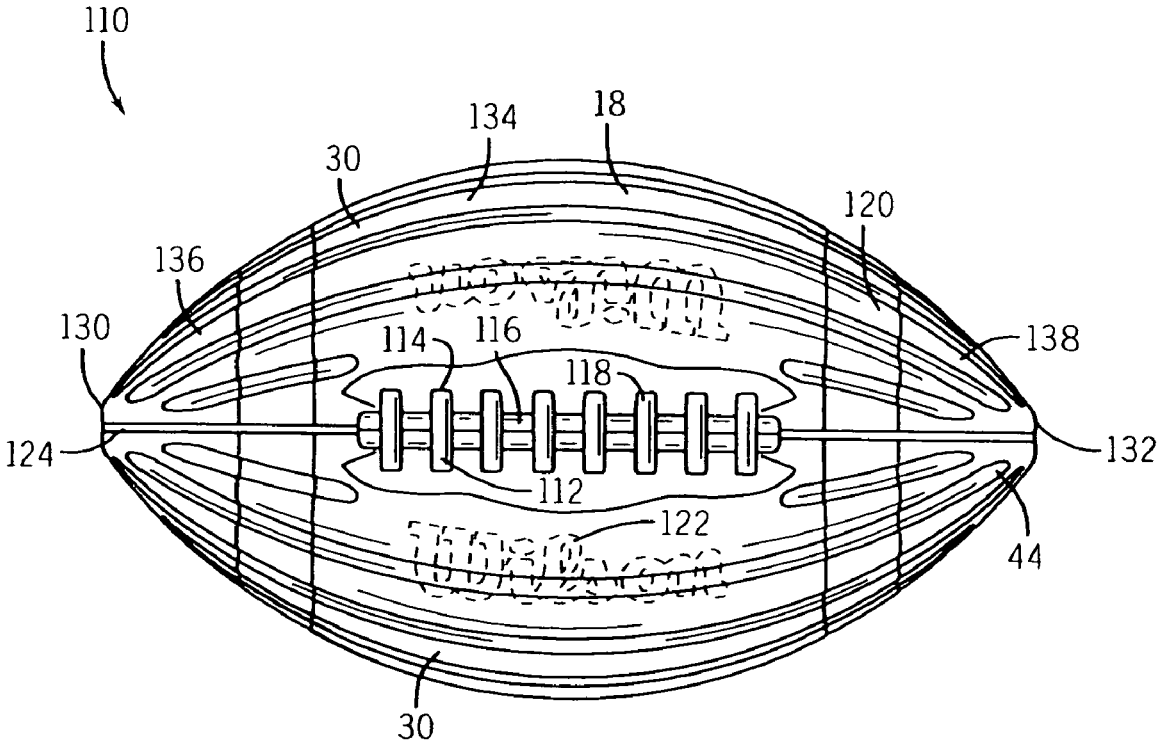
FIG. 24 is a top view of a football in accordance with a preferred embodiment of the present invention.
Figure 25:
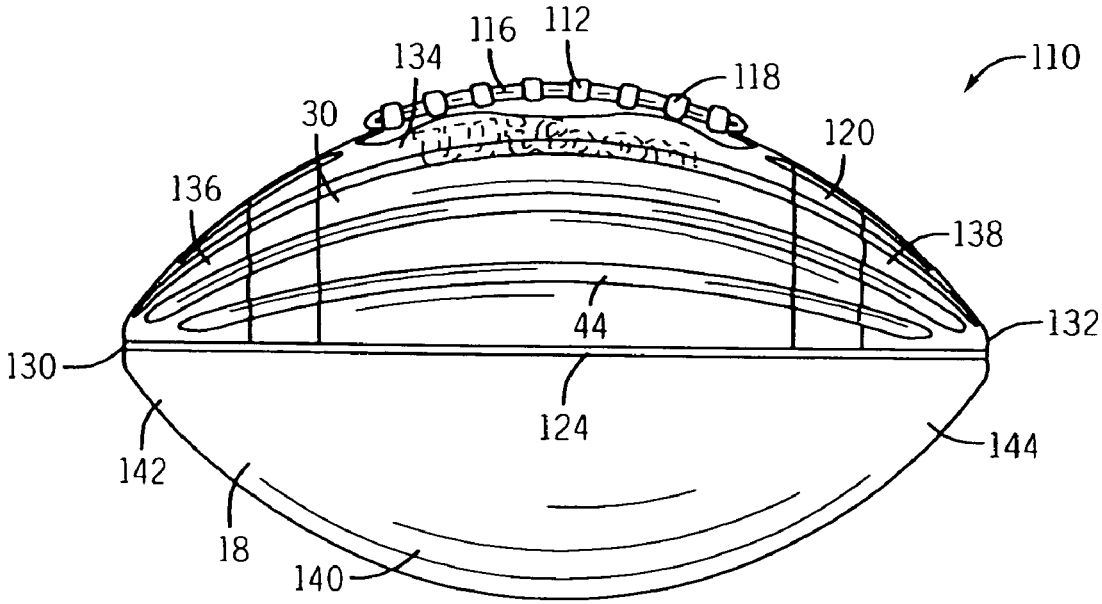
FIG. 25 is a side view of the football of FIG. 24.
Figure 26:
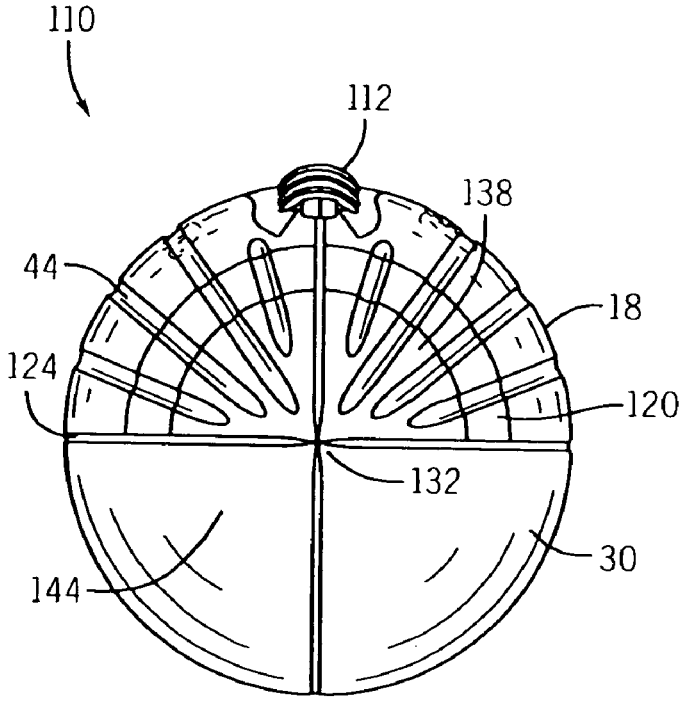
FIG. 26 is an end view of the football of FIG. 24.

As stated above, the present application is directly applicable to other games balls, including, for example, footballs, rugby balls, soccer balls, and volleyballs. In FIGS. 24-26 an alternative preferred embodiment of the present invention is illustrated. The game ball is an American style football 110. The football 110 is a generally prolate spheroidal shaped inflatable object having a major longitudinal dimension and a minor transverse dimension. The football 110 includes the bladder 12 (see FIG. 3), the cover assembly 18 and a lacing 112. The bladder 12 is the same as the bladder described for the basketball 10 with the exception of its shape. The bladder 12 for the football has a generally prolate spheroidal shape.

The cover assembly 18 of the football 110 is substantially the same as the cover assembly described above for the basketball 10. The cover assembly 18 for a football can include one or more cover panels 30 (the cover panels may also be described as cover regions). In one preferred embodiment, the football 110 includes four cover panels 30. Alternatively, other numbers of cover panels can be used, such as, for example, the number of cover panels can number at least two and no more than ten. The cover panels 30 can include the outer layer 40 and the backing 42 (for example, see FIG. 33). Alternatively, the cover panels 30 can be formed without the backing 42 (for example, see FIG. 32 or 34). Alternatively, as described above, the cover assembly can be a one piece structure molded, sprayed, painted on or otherwise applied to the ball.

The football 110 can be constructed in a number of different ways. For example, the constructions illustrated in FIGS. 6-16 are all also applicable to the football 110. Accordingly, in one preferred embodiment, the bladder 12 can be covered by the layer of windings 14 and the carcass 16 can be disposed over the layer of windings 14. In another preferred embodiment, one or more of the inserts 50 can be used in the construction of the football 110. The inserts 50 can be positioned between the carcass and the cover assembly 18 or between the backing 42 and outer layer 40 of the cover assembly 18. The inserts 50 can comprise a large number of separate elongate pads or a smaller quantity of larger pads that approach the size of one of the cover panels. In another preferred embodiment, a lining formed of tough, wear resistant material can be placed beneath the cover panels 30. The lining can be used in addition to or in place of the layer of windings 14, and/or the backing 42. In another alternative embodiment, the backing 42 of the cover panels 30 can be formed of a tough, wear resistant material and used in lieu of the layer of windings 14.

Referring to FIGS. 24-26, the cover panels 30 can be stitched together, or adhered or laminated to the layer of the ball directly beneath the cover panels 30, such as the carcass 16, the lining, the insert(s) or the bladder. Alternatively, the cover panels 30 can be attached to adjacent cover panels or to the layers below the cover panels through molding, pressing, bonding and combinations thereof. When stitched together, the cover panels 30 are typically formed inside out and then inverted such that the stitched edges (or seams) of the cover panels are directed inward thereby typically forming an inwardly positioned channel, or collectively, the first set of channels 124. The first set of channels 124 can be formed similar to the first set of channels 24 or formed as elongate recesses created by the inverted seams of the stitched cover panels 30.

The lacing 112 can be positioned at the edges of two of the cover panels 30. The lacing 112 is preferably a single elongate cord. Alternatively, the lacing 112 can include a plurality of cords. The lacing 112 is threaded through the lace holes 114 of the two adjacent cover panels 30 of the cover assembly 18. The lacing 112 enables the two parallel longitudinally extending rows of spaced apart lace holes 114 to be drawn together thereby closing the slot 32 retaining the bladder within the cover assembly 18. Prior to completing the lacing 112, the slot formed by the unconnected edges of adjacent cover panels can be used to insert the bladder within the football. Alternatively, the cover assembly 18 and other components can be applied to the outer surface of the bladder. When installed onto the football 110, the lacing 112 preferably includes two substantially exposed longitudinally extending segments 116 and eight substantially exposed transversely extending segments 118. In alternative preferred embodiments, other numbers of substantially exposed longitudinal and transverse segments 116 and 118 can be used. The longitudinal and transverse segments 116 and 118 of the lacing outwardly extend from the cover assembly 18 or casing to provide raised surfaces for a player to contact when passing, catching or holding onto the football 110. In one preferred embodiment, an installed lacing 112 has a length of approximately 4.5 inches. Alternatively, the lacing can be formed of other lengths.

The outer surface of the cover panels 30 and the cover it self can include a pebbled texture for enhancing the grip and improving the aesthetics of the football 110. Additionally, the cover assembly 18, and cover panels 30, can also include one or more stripes 120 and indicia 122 indicative of a logo, a trademark, instructions, a design or other configuration.

Referring to FIGS. 24-26, the outer surface of the cover assembly 18 or the cover panels 30 form or define one or more grooves 44. The grooves 44 can be substantially the same as described above with respect to the basketball 10. Accordingly, as illustrated in FIGS. 6-16, the grooves 44 can be formed by the shape of the outer surface of the carcass 16, by a plurality of inserts 50, the configuration of the backing 42, the configuration of the cover panel 30 or combinations thereof.

The football 110 includes first and second ends 130 and 132, an upper central region 134 positioned between first and second upper end regions 136 and 138, and a lower central region 140 positioned between first and second lower end regions 142 and 144. The grooves 44 of the embodiment of FIGS. 24-26 generally extend longitudinally about the football 110. Some of the grooves 44 extend from the first upper end region 136 through the upper central region 134 and into the second upper end region 138, and other grooves 44 extend only through one of the first and second upper end regions 136 and 138. The grooves 44 can be arranged solely in a generally longitudinal direction as illustrated in FIGS. 24-26. Alternatively, in other preferred embodiments, the grooves 44 can extend transversely, in an angled manner, in a curved manner or combinations thereof.

The football 110 of the embodiment of FIGS. 24-26 includes four cover panels 30. Two of the cover panels 30 are positioned on the upper portion of the football and the remaining two cover panels are position on the lower portion of the ball. Each of the two cover panels 30 on the upper end of the football 110 include five grooves 44, three grooves extending from near the first end 130 to near the second end 132 of the football, and the remaining two grooves are positioned solely on either the first or second upper portions 136 and 138 of the football 110. In one embodiment, the grooves 44 can have a depth of greater than or equal to 0.3 mm and less than or equal to 10.0 mm, and a width that is greater than or equal to 2 mm and less than or equal to 20 mm. In a more particular embodiment, the depth of the grooves can be greater than or equal to 0.6 mm and less than or equal to 7.0 mm. It is contemplated that other specific depths or sub-ranges of depth within the larger range of 0.3 mm to 10.0 mm can be used and are considered to be within the scope of the present invention.

Figure 31:
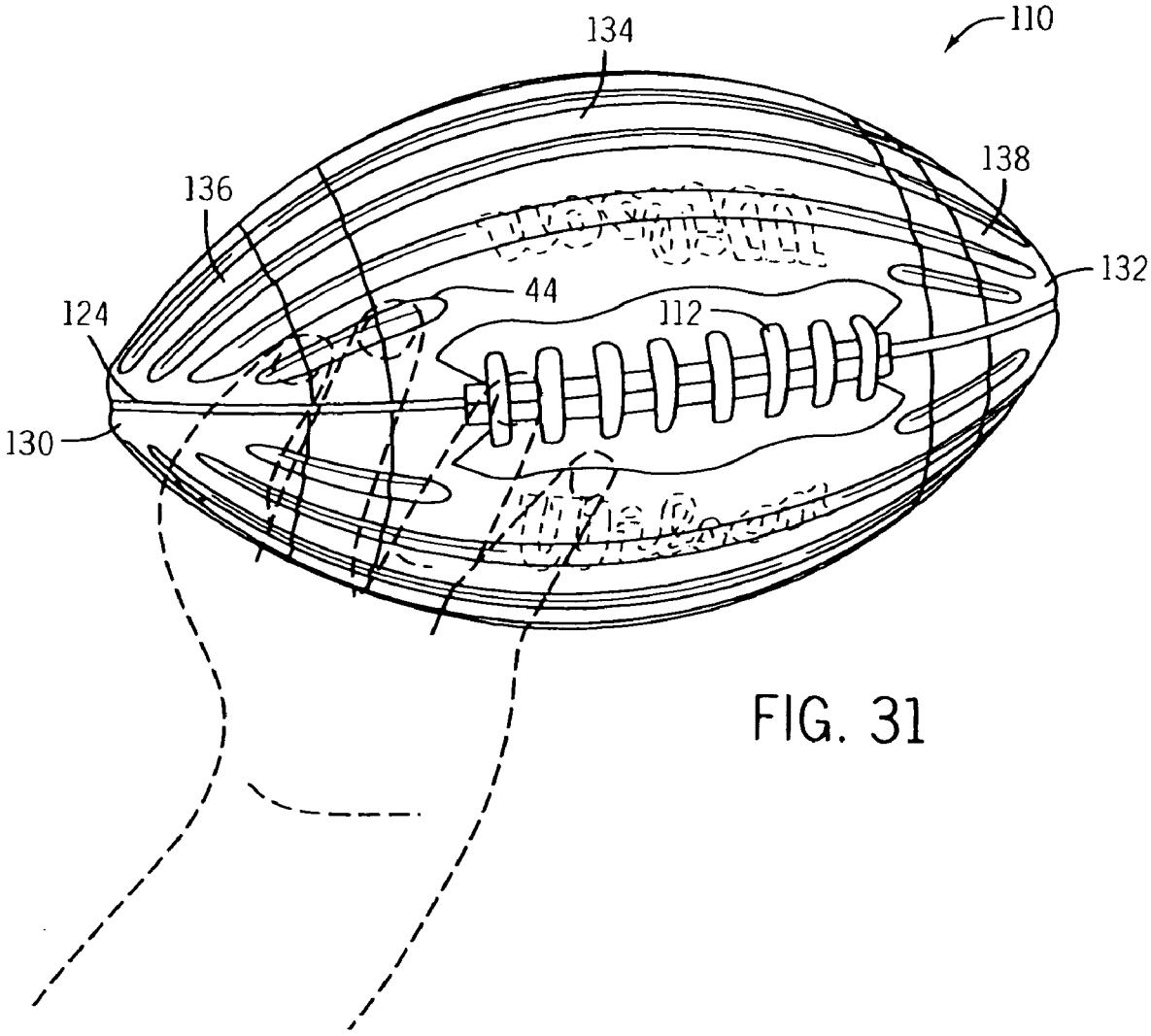
FIG. 31 is a top perspective view of the football of FIG. 24 with an outline of a user's hand placed over the football in a passing position.

Referring to FIG. 31, the grooves 44 provide additional recessed locations for a player to place his or her fingertips into, thereby improving the player's ability to grasp, throw, retain, and/or catch the football 110. Each groove is preferably sufficiently sized to receive at least a portion of one or more of the user's fingertips. Accordingly, the player can readily position his or her hand onto the football and easily orientate the football such that one or more of the player's finger tips rest at or in one or more of the grooves, another one or more fingertips can rest at or on the lacing 112 and one or more of the finger tips of the player can rest at the first set of channels 124. The multiple recessed or raised locations on the ball formed by the lacing 112, the grooves 44 and the first set of channels 124 significantly improves the grip-ability of the ball, the player's ability to control the ball, respond quickly with the ball, retain, throw or catch the ball.

Figure 27:
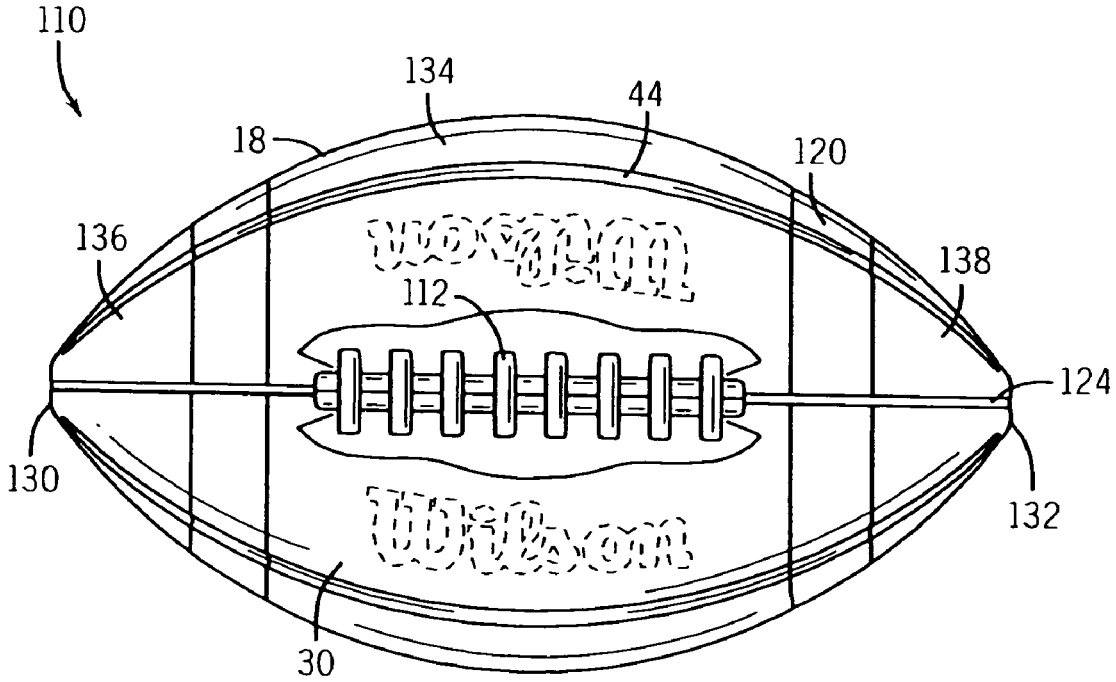
FIG. 27 is a top view of a football in accordance with another preferred embodiment of the present invention.
Figure 28:
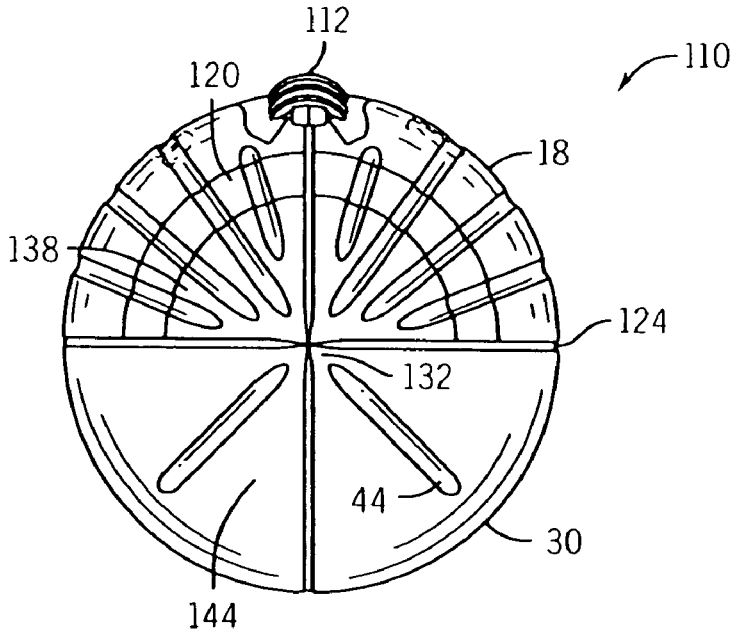
FIG. 28 is an end view of a football in accordance with another preferred embodiment of the present invention.
Figure 29:
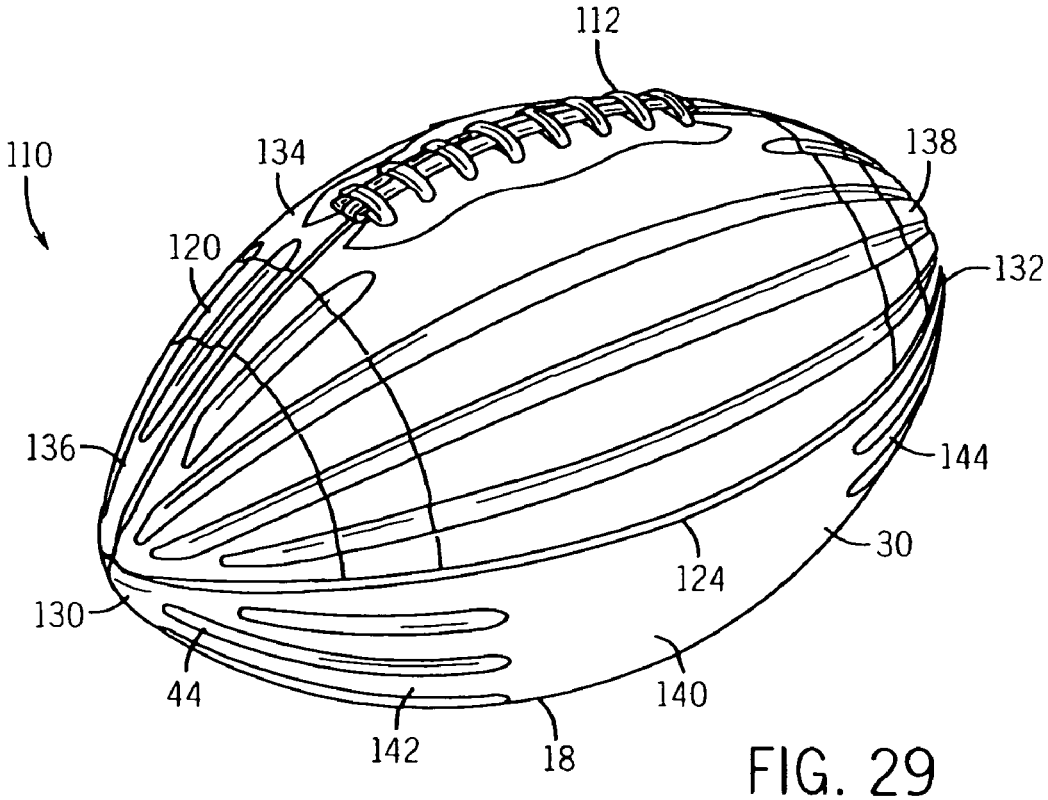
FIG. 29 is a top, side perspective view of a football in accordance with another preferred embodiment of the present invention.
Figure 30:
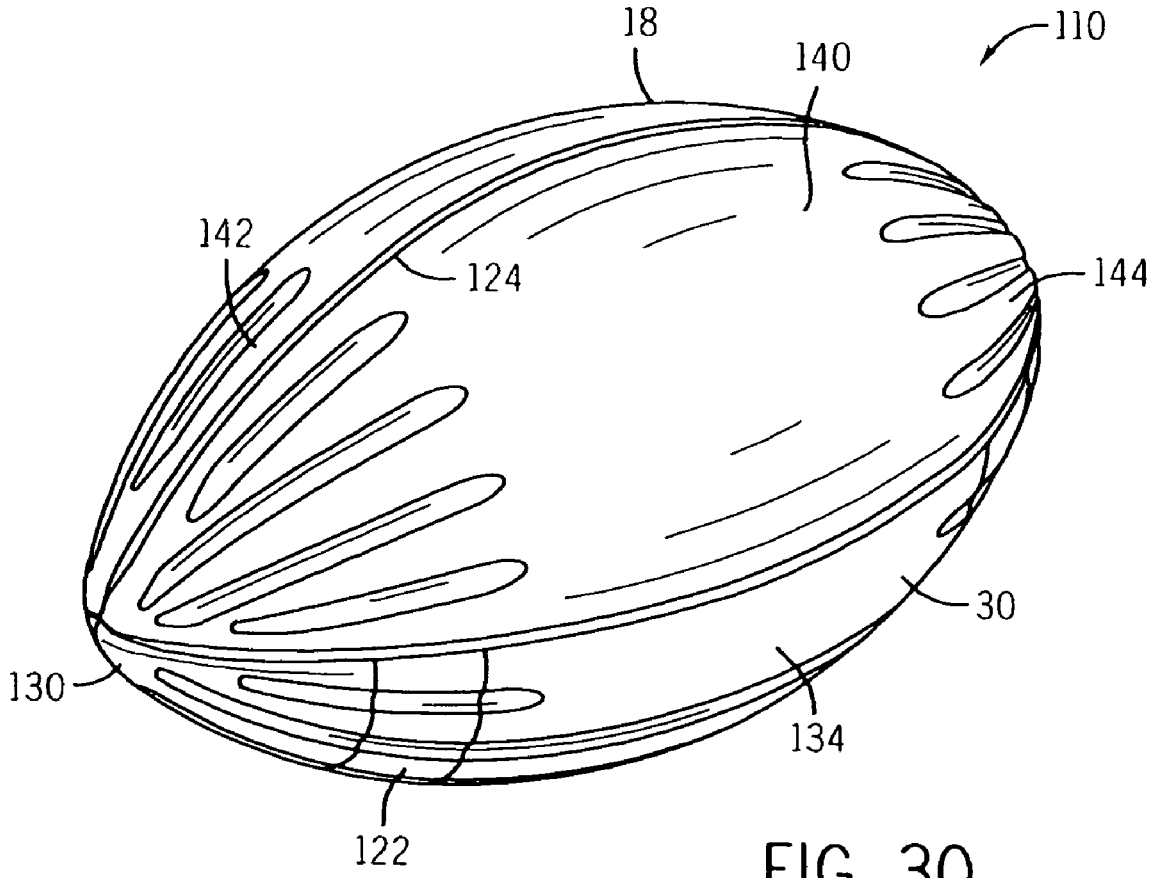
FIG. 30 is a bottom, side perspective view of a football in accordance with another preferred embodiment of the present invention.

Referring to FIGS. 27-29, other alternative preferred embodiments for the football 110 of the present invention are illustrated. The embodiments illustrated in the Figures are exemplary only and are not intended to limit the scope and/or breadth of the present invention. It is contemplated that other game ball configurations can be employed utilizing the present invention. FIGS. 27-29 demonstrate that each cover panel 30 can include different numbers of grooves 44 and grooves having different and varying lengths. For example, each cover panel can include one, two, three, four or more grooves. In one set of preferred embodiments, the grooves can number from greater than or equal to two and less than or equal to forty. Further, the grooves 44 extend generally longitudinally about the outer surface of the football 110. In alternative preferred embodiments, the grooves 44 can extend generally linearly, can be line segments, can be curved, curved segments, circular, other closed curved shapes and/or combinations thereof.

Advantageously, each of the embodiments, illustrated in FIGS. 25, 26 and 28-30 includes no grooves in the lower central region 140 of the football 110. By forming the lower central region 140 without grooves 44, the area of the football 110 that is most commonly impacted by a player's foot during kick-offs, punts, field goals and extra points is unaffected by grooves 44. Accordingly, the kicker can maintain the traditional football surface area to impact the ball while other players, such as quarterbacks, running backs and receivers can utilize the grooves 44 advantageously positioned at other locations on the ball to improve the player's ability to pass, catch and hold onto the football 110. In these embodiments, the likelihood that a kicker would impact one of the grooves 44 upon kicking and experience an undesired ball path or ball flight is significantly reduced. Thus, the football satisfies all player's needs. The grooves 44 can extend over all the upper central region 134, the first and second upper end regions, and the first and second lower end regions.

The grooves can extend over any or all the regions of the football. In one preferred embodiment the grooves 44 can extend only in one or more of the first and second upper and lower end regions. In another embodiment, the grooves can be positioned only on the upper side of the football or only on the lower side of the football. In other embodiments, the grooves can be positioned only in one or more of the central regions.

Figure 32:
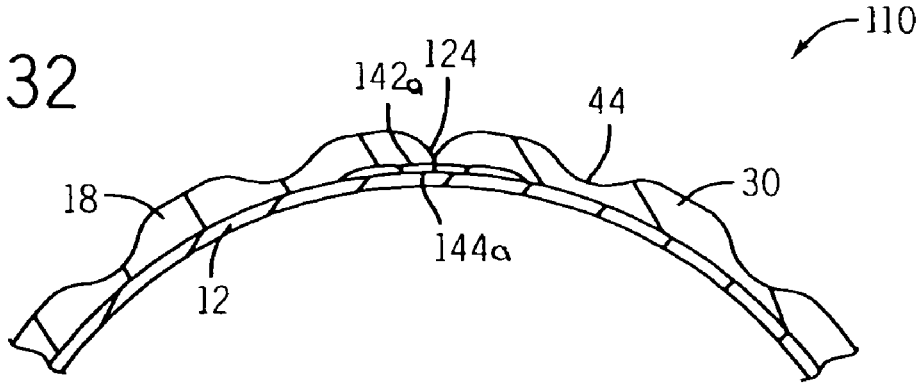
FIG. 32 is a cross-sectional view of a football in accordance with an alternative preferred embodiment of the present invention.

Referring to FIG. 32, a cross-section of a football 110 built in accordance with one preferred embodiment of the present invention is illustrated. The football 110 can be constructed with the bladder 12 and cover panels 30 positioned directly over the bladder 12. The cover panels 30 are preferably stitched together through stitching 142*a*. The cover panels 30 can also be applied to the bladder 12 through an adhesive or molding process. The edges 144*a* of the cover panels 30 are curved inward at the stitching 142*a* thereby forming one of the first set of channels 124 on the outer surface of the football 110. The thickness of the cover panels 30 is variable thereby defining the grooves 44 within the football 110.

Figure 33:
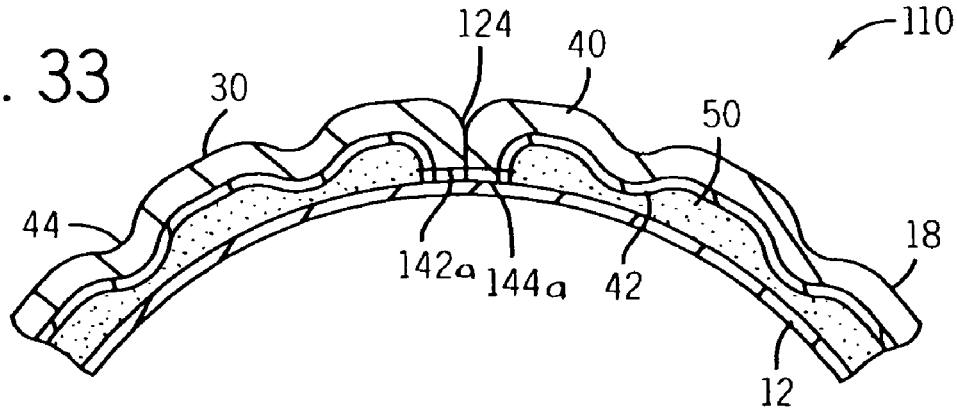
FIG. 33 is a cross-sectional view of a football in accordance with another alternative preferred embodiment of the present invention.

Referring to FIG. 33, a cross-section of a football 110 built in accordance with another preferred embodiment of the present invention is illustrated. The football 110 is constructed with the bladder 12, one insert 50 of padding material placed over the bladder 12. The insert 50 is formed with the second set of channels 36. The cover panels 30 include the outer layer 40 and the backing 42, which generally conform to the shape of the outer surface of the insert 50 thereby forming the grooves 44 in the outer surface of the cover panels 30. The edges 144*a* of the cover panels 30 can be stitched together through stitching 142*a*. The padding material of the insert 50 can be highly resilient and compressible, or relatively stiff and resistant to significant deflection.

Figure 34:
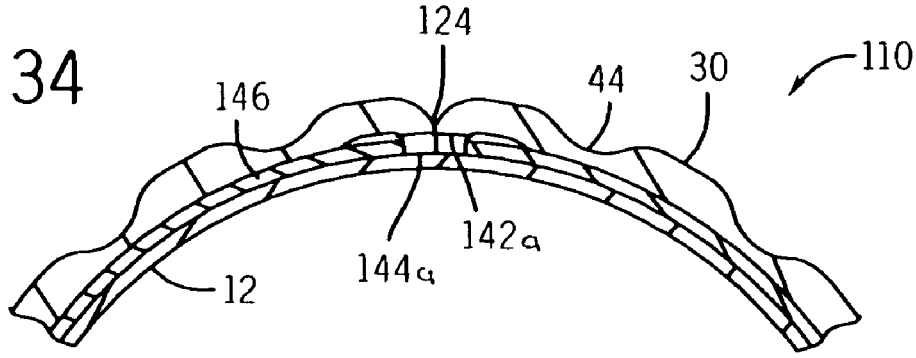
FIG. 34 is a cross-sectional view of a football in accordance with another alternative preferred embodiment of the present invention.

Referring to FIG. 34, a cross-section of a football 110 built in accordance with another preferred embodiment of the present invention is illustrated. The football 110 is constructed with the bladder 12 and a lining 146, preferably formed of a high strength, wear resistant material, is disposed over the bladder 12. The lining 146 can be a single piece layer of material or formed from multiple pieces or layers. The cover panel 30 is positioned over the lining 146. The edges 144*a* of the cover panels 30 can be stitched together through stitching 142*a*. The cover panels 30 can be formed of variable thickness so as to define the grooves 44 in the cover panels 30.

Referring to FIGS. 35 and 36, another alternative embodiment of the present invention is illustrated. The football 110 can be formed with a plurality of outwardly extending ridges 52 projecting from the outer surface of the cover assembly 18. The ridges 52 are substantially the same as the ridges 52 described earlier with respect to the basketball 10. The ridges 52 can be positioned about the football 110 in a manner similar to the grooves 44. Like the grooves 44, the ridges 52 provide regions of the football 110 that are easier to grasp thereby enabling the player to pass, grasp, retain and catch. The ridges provide raised sections of the football 110 that the player can place one or more fingertips on or near in order to improve his or her ability to grasp, throw or catch the football. The ridges 52 can be formed on the outer surface of the football 110 in the same manner described and illustrated above with respect to FIG. 9, 10, 14 or 16. Additionally, FIG. 36 illustrates another construction in which the football 110 includes the bladder 12, and an intermediate layer 152 of material is placed over the bladder 12. The layer 152 of material can be the layer of windings 14 and/or the carcass 16, the lining 146 and an intermediate padding layer. Above this layer or formed integrally with this layer is a plurality of the inserts 50 projecting outward from the bladder 12. The cover panels 30 including the backing 42 and the outer layer 40 are applied over the and generally conform to the shape of the inserts 50 and the intermediate layer 152 to form the outwardly projecting ridges 52 in the outer surface of the cover panels 30.

Figure 37:
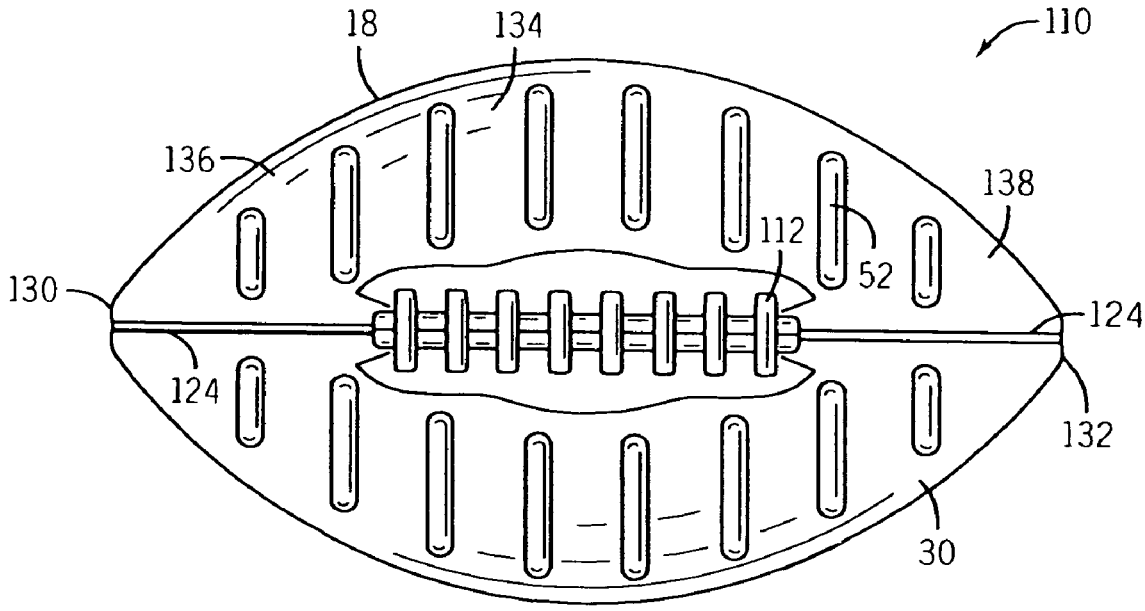
FIG. 37 is a top perspective view of a football in accordance with another preferred embodiment of the present invention.

Referring to FIG. 37, the football 110 can be constructed such that the ridges 52 extend in a generally transverse direction about the football 110. As described above, the ridges 52 can be configured or orientated in other locations, numbers, lengths and widths in a manner similar to that of the grooves 44. Accordingly, other such arrangement are contemplated by the present invention including, but not limited to, one or more ridges 52 and grooves 44 being formed and/or defined onto a single game ball.

Footballs built in accordance with the present invention enable a player to more quickly locate and orientate the football with his or her fingertips contacting one or more channels in the outer surface of the football prior to passing. The additional grooves and/or the additional ridges included in the various embodiments of the present invention allow for the football to be easier to grasp with a single hand or with both hands. Footballs built in accordance with the present invention can improve a player's ability to easily grasp, handle, pass, catch, retain, lateral and otherwise control the ball during use without radically departing from the ball's traditional design. The optimal positioning of the additional grooves and/or ridges further enhances the playability of the football. The additional grooves and/or ridges also facilitate a player's ability to produce a spiral type ball motion when passing the football. The improved maneuverability offered by the footballs of the present invention can also assist in reducing turnovers. This feature is particularly significant in certain levels of competitive football where each team is allowed to select its own ball. A team utilizing the football of the present invention will benefit from the football's features. A team using a football in accordance with the present invention can reduce the risk of turning over the football, improve the passing accuracy of its quarterback and the ability of other players to catch and hold on to the football. The footballs are also well-suited for inclement weather or game conditions where players' perspiration can play a role in the ability to grasp and control a game ball. Further, footballs built in accordance with the present invention provide an improved feel to the player, and also a unique appealing aesthetic. The outer surface of the game ball is also well-suited for inclement weather or game conditions where players' perspiration can play a role in the ability to grasp and control a game ball.

While the preferred embodiments of the present invention have been described and illustrated, numerous departures therefrom can be contemplated by persons skilled in the art. For example, any layer or portion of the game ball, or a combination of two or more layers or portions of the game ball, including the bladder, the layer of windings, the carcass, the lining, a padding layer, the cover layer, and/or the backing can be formed so as to define grooves and/or ridges into the outer surface of the game ball. Therefore, the present invention is not limited to the foregoing description but only by the scope and spirit of the appended claims.

What is claimed is:

1. A football having a generally prolate spheroidal shape and opposing first and second ends, the football comprising:

a bladder;

a cover disposed over the bladder, the cover formed of at least one cover panel, the cover defining, at least in part, a first set of channels extending generally longitudinally from at or near the first end of the football to at or near the second end of the football, the cover having an outer surface and including a plurality of outwardly projecting ridges configured to facilitate grasping and throwing of the football, the height of the ridge being greater than or equal to 0.3 mm and less than or equal to 10 mm; and a lacing, the football including an upper central region positioned between first and second upper end regions, and a lower central region positioned between first and second lower end regions, the lacing coupled to the upper central region of the cover, the plurality of ridges extending over the first and second upper end regions, and the first and second lower end regions of the football, the upper central region and the lower central region of the football being formed without the plurality of ridges, the lacing having a first length and the upper and lower central regions having a second length that is generally equal to the first length.

2. The football of claim 1, further comprising a carcass covering the bladder and disposed under the cover.

3. The football of claim 2, wherein the carcass has an outer surface includes a plurality of ribs, and wherein the cover generally conforms to the shape of the outer surface of the carcass such that the plurality of ridges in the outer surface of the football generally correspond to the plurality of ribs.

4. The football of claim 1, further comprising at least one pad positioned between the bladder and the cover.

5. The football of claim 4, wherein the at least one pad has an outer surface that defines a plurality of ribs, and wherein the cover generally conforms to the shape of the outer surface of the at least one pad such that the plurality of ridges in the outer surface of the football generally correspond to the second set of ribs.

6. The football of claim 1, further comprising a plurality of spaced apart elements positioned between the bladder and the cover.

7. The football of claim 6, wherein the cover generally conforms to the shape of the outer surface of the plurality of spaced apart elements such that the spaced apart elements contribute to the formation of the plurality of outwardly projecting ridges in the outer surface of the football.

8. The football of claim 1, wherein the cover has a variable wall thickness enabling regions of reduced thickness in the cover to define, at least in part, the plurality of ridges.

9. The football of claim 1, wherein the cover includes an outer layer and a backing, and wherein the backing has variable thickness enabling the cover to define the plurality of ridges.

10. The football of claim 1, wherein the football is configured for organized, competitive play.

11. The football of claim 1, wherein the cover includes at least two and no more than ten cover panels, and wherein the first set of channels generally define edges of the cover panels.

12. The football of claim 9, wherein each cover panel defines at least one of the plurality of ridges.

13. The football of claim 9, wherein each cover panel defines at least two of the plurality of ridges.

14. The football of claim 1, wherein the plurality of ridges number within the range of two to forty ridges.

15. The football of claim 14, wherein the plurality of ridges number within the range of four to twenty ridges.

16. The football of claim 1, wherein the height of the plurality of ridges is greater than or equal to 0.6 mm and less than or equal to 7 mm.

17. The football of claim 1, wherein at least one of the ridges extends longitudinally about the outer surface of the football.

18. The football of claim 1, wherein the plurality of ridges are configured in a shape selected from the group consisting of a line segment, a curved segment, a circle, a closed curved shape and combinations thereof.

19. The football of claim 1, wherein the outer surface of the cover includes a pebbled texture.

20. The football of claim 1, wherein the plurality of ridges extend over at least two of the regions of the football.

21. The football of claim 1, wherein the plurality of ridges extend over at least two of the first and second upper end regions and the first and second lower end regions of the football.

22. The football of claim 1, wherein the outer surface of cover defines at least one groove.

23. The football of claim 1, wherein the lacing is coupled to the upper central region of the football.

24. The football of claim 1, wherein the at least one cover panel is two or more cover panels, and wherein the cover panels define a first set of channels in an outer surface of the football.

* * * * *